US010073364B2

(12) United States Patent
Kigoshi et al.

(10) Patent No.: US 10,073,364 B2
(45) Date of Patent: Sep. 11, 2018

(54) ELECTROPHOTOGRAPHIC PHOTORECEPTOR AND IMAGE FORMING APPARATUS

(71) Applicant: FUJI XEROX CO., LTD., Tokyo (JP)

(72) Inventors: Yoichi Kigoshi, Kanagawa (JP); Masaki Hirakata, Kanagawa (JP); Satomi Kashiwagi, Kanagawa (JP); Nobuyuki Torigoe, Kanagawa (JP); Takeshi Iwanaga, Kanagawa (JP); Takashi Imai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/647,939

(22) Filed: Jul. 12, 2017

(65) Prior Publication Data

US 2018/0095372 A1 Apr. 5, 2018

(30) Foreign Application Priority Data

Oct. 4, 2016 (JP) ..... 2016-196587

(51) Int. Cl.
*G03G 5/082* (2006.01)
*G03G 5/14* (2006.01)
(Continued)

(52) U.S. Cl.
CPC ..... *G03G 5/144* (2013.01); *G03G 5/047* (2013.01); *G03G 5/0535* (2013.01); *G03G 5/0542* (2013.01); *G03G 5/0564* (2013.01); *G03G 5/0614* (2013.01); *G03G 5/0696* (2013.01); *G03G 5/102* (2013.01); *G03G 15/75* (2013.01)

(58) Field of Classification Search
CPC ..... G03G 5/0436; G03G 5/14704
See application file for complete search history.

(56) References Cited

U.S. PATENT DOCUMENTS 4,848,141 A 7/1989 Oliver et al.
5,298,617 A 3/1994 Nukada et al.
(Continued)

FOREIGN PATENT DOCUMENTS

EP 0710893 A1 5/1996
JP H04-189873 A 7/1992
(Continued)

*Primary Examiner* — Peter L Vajda
(74) *Attorney, Agent, or Firm* — Oliff PLC

(57) ABSTRACT

Electrophotographic photoreceptor including a conductive substrate, an organic photosensitive layer on an outer peripheral surface of the conductive substrate, and an inorganic protective layer on an outer peripheral surface of the organic photosensitive layer, the inorganic protective layer containing gallium and oxygen. A volume resistivity of an inner region of the inorganic protective layer, the inner region extending 0.2 μm or about 0.2 μm from an inner peripheral surface of the inorganic protective layer in a thickness direction, and a volume resistivity of an outer region of the inorganic protective layer, the outer region extending 0.2 μm or about 0.2 μm from an outer peripheral surface of the inorganic protective layer in the thickness direction, are both $6.0\times10^{7}$ Ω·cm or more and $4.0\times10^{8}$ Ω·cm or less or about $6.0\times10^{7}$ Ω·cm or more and about $4.0\times10^{8}$ Ω·cm or less.

4 Claims, 4 Drawing Sheets

(51) Int. Cl.

| | |
|---|---|
| ***G03G 15/00*** | (2006.01) |
| ***G03G 5/10*** | (2006.01) |
| ***G03G 5/06*** | (2006.01) |
| ***G03G 5/05*** | (2006.01) |
| ***G03G 5/047*** | (2006.01) |

(56) References Cited

U.S. PATENT DOCUMENTS

| | | | | |
|---|---|---|---|---|
| 5,302,479 | A | 4/1994 | Daimon et al. | |
| 5,459,004 | A | 10/1995 | Daimon et al. | |
| 2014/0295334 | A1* | 10/2014 | Hirakata ..... | G03G 5/0436 430/56 |

FOREIGN PATENT DOCUMENTS

| | | | |
|---|---|---|---|
| JP | H05-98181 | A | 4/1993 |
| JP | H05-140472 | A | 6/1993 |
| JP | H05-140473 | A | 6/1993 |
| JP | H05-263007 | A | 10/1993 |
| JP | H05-279591 | A | 10/1993 |
| JP | H08-176293 | A | 7/1996 |
| JP | H08-208820 | A | 8/1996 |
| JP | 2004-078147 | A | 3/2004 |
| JP | 2005-181992 | A | 7/2005 |
| JP | 2011-197571 | A | 10/2011 |
| JP | 2012-155282 | A | 8/2012 |

* cited by examiner

ELECTROPHOTOGRAPHIC PHOTORECEPTOR AND IMAGE FORMING APPARATUS

CROSS-REFERENCE TO RELATED APPLICATIONS

This application is based on and claims priority under 35 USC 119 from Japanese Patent Application No. 2016-196587 filed Oct. 4, 2016.

BACKGROUND

Technical Field

The present invention relates to an electrophotographic photoreceptor and an image forming apparatus.

SUMMARY

According to an aspect of the invention, there is provided an electrophotographic photoreceptor including a conductive substrate, an organic photosensitive layer on an outer peripheral surface of the conductive substrate, and an inorganic protective layer on an outer peripheral surface of the organic photosensitive layer, the inorganic protective layer containing gallium and oxygen. A volume resistivity of an inner region of the inorganic protective layer, the inner region extending 0.2 μm or about 0.2 μm from an inner peripheral surface of the inorganic protective layer in a thickness direction, and a volume resistivity of an outer region of the inorganic protective layer, the outer region extending 0.2 μm or about 0.2 μm from an outer peripheral surface of the inorganic protective layer in the thickness direction, are both $6.0\times10^7$ Ω·cm or more and $4.0\times10^8$ Ω·cm or less or about $6.0\times10^7$ Ω·cm or more and about $4.0\times10^8$ Ω·cm or less.

BRIEF DESCRIPTION OF THE DRAWINGS

Exemplary embodiments of the present invention will be described in detail based on the following figures, wherein.

DETAILED DESCRIPTION

Figure 1:
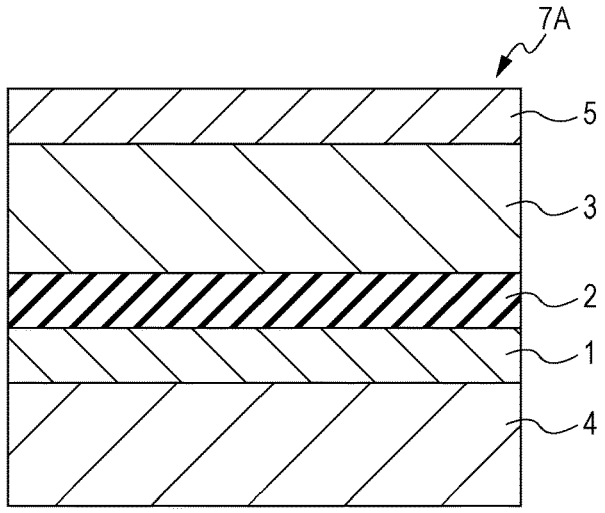
FIG. 1 is a schematic cross-sectional view of an example layer configuration of an electrophotographic photoreceptor according to an exemplary embodiment.

Exemplary embodiments of the present invention will now be described in detail.

Electrophotographic Photoreceptor

An electrophotographic photoreceptor (hereinafter may be simply referred to as a "photoreceptor") according to a first exemplary embodiment includes a conductive substrate, an organic photosensitive layer on an outer peripheral surface of the conductive substrate, and an inorganic protective layer on an outer peripheral surface of the organic photosensitive layer.

The inorganic protective layer contains gallium and oxygen. The volume resistivity in a region (hereinafter may also be referred to as an "inner region") that extends 0.2 μm or about 0.2 μm from the inner peripheral surface of the inorganic protective layer in a thickness direction and the volume resistivity in a region (hereinafter may also be referred to as an "outer region") that extends 0.2 μm or about 0.2 μm from the outer peripheral surface of the inorganic protective layer in the thickness direction are both $6.0\times10^7$ Ω·cm or more and $4.0\times10^8$ Ω·cm or less or about $6.0\times10^7$ Ω·cm or more and about $4.0\times10^8$ Ω·cm or less.

The inorganic protective layer that contains gallium and oxygen may be referred to as a "gallium oxide layer".

Since the photoreceptor according to the first exemplary embodiment includes a gallium oxide layer serving as an inorganic protective layer and has a volume resistivity of $6.0\times10^7$ Ω·cm or more and $4.0\times10^8$ Ω·cm or less or about $6.0\times10^7$ Ω·cm or more and about $4.0\times10^8$ Ω·cm or less in both the inner region and the outer region, not only scratches on the outer peripheral surface of the inorganic protective layer are kept from appearing in an image, but also image deletion is suppressed. The exact reason for this is not clear, but is presumed to be as follows.

When an electrophotographic photoreceptor that includes an inorganic protective layer on an organic photosensitive layer is used, scratches on the outer peripheral surface of the inorganic protective layer are prone to appear in an image in some cases where the volume resistivity of the inorganic protective layer is excessively high. Specifically, when an outer peripheral surface of the inorganic protective layer has a scratch, a recessed portion is present due to this scratch. When the volume resistivity of the inorganic protective layer is excessively high, charges are likely to accumulate in this recessed portion. In particular, when the speed of rotation of the photoreceptor is high (for example, when the speed of rotation is 8 revolutions per second or higher), the ability to maintain a balance between charging and charge-erasing of the photoreceptor is degraded, and extensive charge accumulation may occur in the recessed portion generated by the scratch. Once charges are accumulated in the scratch, an image defect (for example, the difference in image density between the recessed portion generated by the scratch and its surrounding region) caused by local charge accumulation may occur in the formed image in the region corresponding to the scratch on the inorganic protective layer.

When the volume resistivity of the inorganic protective layer is excessively low, it is difficult to immobilize charges on the outer peripheral surface of the photoreceptor, and charge migration readily occurs. As a result, image deletion caused by charge migration may occur.

In sum, when the volume resistivity of an inorganic protective layer formed on the organic photosensitive layer in the electrophotographic photoreceptor is excessively high, scratches on the outer peripheral surface of the inorganic protective layer are prone to appear in an image. When the volume resistivity of the inorganic protective layer is excessively low, image deletion may occur. A possible approach for controlling both the proneness of scratches, which are formed on the outer peripheral surface of the inorganic protective layer, to appear in the image and the likelihood of image deletion is to adjust the volume resistivity of the inorganic protective layer.

However, in an electrophotographic photoreceptor that includes a gallium oxide layer disposed on an organic photosensitive layer, the composition of the inner peripheral surface side (the region close to the organic photosensitive layer) of the inorganic protective layer and the composition of the outer peripheral surface side of the inorganic protective layer are different from each other. As a result, the volume resistivity often differs between the inner peripheral surface side and the outer peripheral surface side.

Specifically, an example of the method for forming a gallium oxide layer on an organic photosensitive layer is a plasma chemical vapor deposition (CVD) method. In forming a gallium oxide layer by the plasma CVD method, the temperature of the conductive substrate on which an organic photosensitive layer is formed (hereinafter this temperature may be referred to as the "substrate temperature" for the sake of convenience) rises during the course of deposition. As the substrate temperature rises, it becomes increasingly difficult for the film to incorporate oxygen. Thus, a gallium oxide layer obtained by a typical method of continuing film deposition without changing deposition conditions such as the amount of oxygen supplied has a smaller oxygen concentration in the outer peripheral surface side than in the inner peripheral surface side when viewed microscopically. Thus, the volume resistivity of the outer peripheral surface side is low compared to the volume resistivity of the inner peripheral surface side.

When the volume resistivity of the inorganic protective layer differs between the inner peripheral surface side and the outer peripheral surface side and when the volume resistivity obtained by measuring the whole inorganic protective layer spanning from the inner peripheral surface side to the outer peripheral surface side, regions with an excessively high volume resistivity and with an excessively low volume resistivity may locally remain.

For example, even when the volume resistivity of the inorganic protective layer as a whole is at an appropriate value, scratches on the outer peripheral surface of the inorganic protective layer are prone to appear in the image if the volume resistivity in the inner peripheral surface side of the inorganic protective layer is locally excessively high. For example, even when the volume resistivity of the inorganic protective layer as a whole is at an appropriate value, image deletion is likely to occur if the volume resistivity in the outer peripheral surface side of the inorganic protective layer is locally excessively low.

Thus, simply adjusting the volume resistivity of the inorganic protective layer as a whole causes the volume resistivity to be locally excessively high or excessively low as described above, and it is difficult to achieve, both at a high level, keeping scratches on the inorganic protective layer from appearing in the image and suppressing image deletion.

In contrast, in the photoreceptor of the first exemplary embodiment, the volume resistivity of the inner region in the inorganic protective layer and the volume resistivity of the outer region in the inorganic protective layer are both $6.0\times10^{7}$ Ω·cm or more and $4.0\times10^{8}$ Ω·cm or less or about $6.0\times10^{7}$ Ω·cm or more and about $4.0\times10^{8}$Ω·cm or less.

This is to say that, in the first exemplary embodiment, the volume resistivity is not excessively high or low and is within the above-described range in both the outer region and the inner region. Thus, for example, compared to when the volume resistivity is outside the above-described range in at least one of the outer region and the inner region, such as when the oxygen concentration incorporated into the film has decreased during the deposition process, the first exemplary embodiment achieves, at a high level, keeping the scratches on the inorganic protective layer from appearing in the image and suppressing image deletion.

Presumably due to this reason, the first exemplary embodiment achieves keeping the scratches on the inorganic protective layer from appearing in the image and suppressing image deletion.

An electrophotographic photoreceptor according to a second exemplary embodiment includes a conductive substrate, an organic photosensitive layer on an outer peripheral surface of the conductive substrate, and an inorganic protective layer on an outer peripheral surface of the organic photosensitive layer.

The inorganic protective layer contains gallium and oxygen. The photon energy at the wavelength of the optical absorption edge of a region (inner region) extending 0.2 μm or about 0.2 μm from the inner peripheral surface of the inorganic protective layer in the thickness direction (hereinafter this photon energy is also referred to as "optical absorption edge energy") and the optical absorption edge energy of a region (outer region) extending 0.2 μm or about 0.2 μm from the outer peripheral surface of the inorganic protective layer in the thickness direction are both 2.00 eV or more and 2.60 eV or less or about 2.00 eV or more and about 2.60 eV or less.

In the description below, the inorganic protective layer that contains gallium and oxygen may be referred to as a "gallium oxide layer".

The "optical absorption edge energy" refers to a photon energy at a wavelength of the optical absorption edge where the absorption coefficient is $1\times10^{6}$ $m^{-1}$ in an absorption spectrum.

The inorganic protective layer of the photoreceptor according to the second exemplary embodiment is a gallium oxide layer. Since the optical absorption edge energy is 2.00 eV or more and 2.60 eV or less in both the inner region and the outer region of the inorganic protective layer, scratches on the outer peripheral surface of the inorganic protective layer are kept from appearing in the image and the photoreceptor exhibits high sensitivity. The exact reason for this is not clear, but is presumed to be as follows.

In an electrophotographic photoreceptor that includes a gallium oxide layer on an organic photosensitive layer, in some cases, scratches on the outer peripheral surface of the gallium oxide layer are prone to appear in the image when the optical absorption edge energy of the gallium oxide layer is excessively high. Specifically, a gallium oxide layer with an excessively high optical absorption edge energy is a gallium oxide layer having a high oxygen concentration in which oxygen defect rarely occur and electron migration rarely occurs inside the layer. For example, when a scratch is present on the outer peripheral surface of the gallium oxide layer, a recessed portion is present due to this scratch. When the oxygen concentration is high and electron migration rarely occurs inside the layer, charges are likely to accumulate in this recessed portion. In particular, when the speed of rotation of the photoreceptor is high (for example, when the speed of rotation is 8 revolutions per second or higher), the ability to maintain a balance between charging and charge-erasing of the photoreceptor is degraded and extensive charge accumulation may occur in the recessed portion generated by the scratch. Once charges are accumulated in the scratch, an image defect (for example, the difference in image density between the recessed portion generated by the scratch and its surrounding region) caused by local charge accumulation may occur in the formed image in the region corresponding to the scratch on the gallium oxide layer.

A gallium oxide layer with an excessively low optical absorption edge energy has an optical absorption edge on the short wavelength side. Thus, the absorption coefficient at a wavelength (exposure wavelength) of light generated by an exposing unit for forming a latent image on the photoreceptor is increased, and as a result the sensitivity of the photoreceptor may be degraded.

In sum, according to an electrophotographic photoreceptor that includes a gallium oxide layer on an organic photosensitive layer, when the optical absorption edge energy is excessively high, scratches on the gallium oxide layer are prone to appear in the image in some cases. When the optical absorption edge energy is excessively low, the sensitivity of the photoreceptor may be degraded. A possible approach for controlling both the proneness of scratches, which are formed on the outer peripheral surface of the gallium oxide layer, to appear in the image and the sensitivity of the photoreceptor is to adjust the optical absorption edge energy of the gallium oxide layer, for example.

However, as mentioned above, in an electrophotographic photoreceptor that includes a gallium oxide layer disposed on an organic photosensitive layer, the composition of the inner peripheral surface side (the region close to the organic photosensitive layer) of the gallium oxide layer and the composition of the outer peripheral surface side of the gallium oxide layer are different from each other. As a result, the optical absorption edge energy often differs between the inner peripheral surface side and the outer peripheral surface side.

For example, when the optical absorption edge energy at the inner peripheral surface side of the gallium oxide layer is locally excessively high, scratches on the gallium oxide layer may appear in the image. When the optical absorption edge energy at the outer peripheral surface side of the gallium oxide layer is locally excessively low, the sensitivity of the photoreceptor may be degraded. When the optical absorption edge energy differs between the inner peripheral surface side and the outer peripheral surface side of the gallium oxide layer, it is difficult to achieve, both at a high level, keeping the scratches on the gallium oxide layer from appearing in the image and keeping the photoreceptor to have high sensitivity.

In contrast, according to the photoreceptor of the second exemplary embodiment, the optical absorption edge energy of the inner region in the gallium oxide layer and the optical absorption edge energy of the outer region in the gallium oxide layer are both 2.00 eV or more and 2.60 eV or less.

In other words, according to the second exemplary embodiment, the optical absorption edge energy is not excessively high or low and is within the aforementioned range in both the outer region and the inner region. Thus, compared to when the optical absorption edge energy is outside the above-described range in at least one of the outer region and the inner region, such as when the oxygen concentration incorporated into the film has decreased during the deposition process, the second exemplary embodiment achieves, both at a high level, keeping the scratches on the gallium oxide layer from appearing in the image and keeping the photoreceptor to have high sensitivity.

Presumably due to this reason, the second exemplary embodiment achieves both keeping the scratches on the gallium oxide layer from appearing in the image and keeping the photoreceptor to have high sensitivity.

The electrophotographic photoreceptors according to the first and second exemplary embodiments will now be described in detail with reference to the drawings.

In the drawings, the same or equivalent parts are represented by the same reference symbols and descriptions therefor are omitted to avoid redundancy.

The features common to the first and second exemplary embodiments may be referred to as features of "the present exemplary embodiment".

Figure 2:
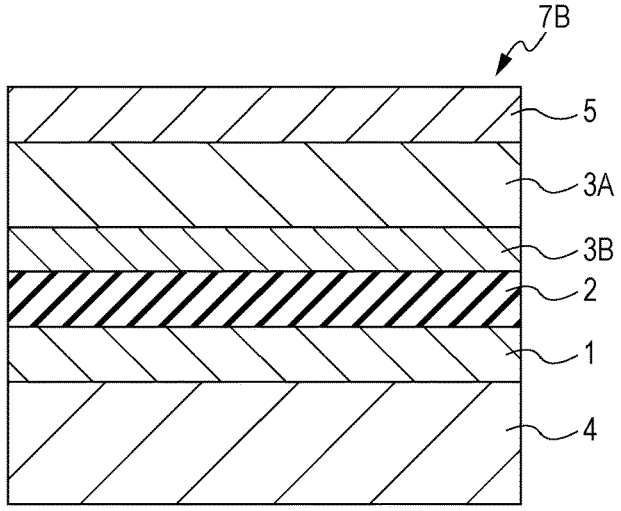
FIG. 2 is a schematic cross-sectional view of another example layer configuration of an electrophotographic photoreceptor according to an exemplary embodiment.
Figure 3:
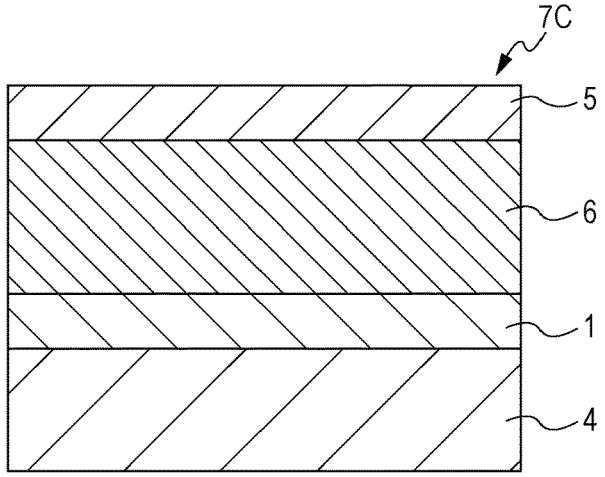
FIG. 3 is a schematic cross-sectional view of yet another example layer configuration of an electrophotographic photoreceptor according to an exemplary embodiment.

FIG. 1 is a schematic cross-sectional view of an example of the electrophotographic photoreceptor according to the present exemplary embodiment. FIGS. 2 and 3 are schematic cross-sectional views respectively illustrating other examples of the electrophotographic photoreceptor of the present exemplary embodiment.

An electrophotographic photoreceptor 7A illustrated in FIG. 1 is what is known as a function-separated photoreceptor (or a layered photoreceptor). An undercoat layer 1 is disposed on a conductive substrate 4. A charge generating layer 2, a charge transporting layer 3, and an inorganic protective layer 5 are sequentially stacked on the undercoat layer 1. In the electrophotographic photoreceptor 7A, the charge generating layer 2 and the charge transporting layer 3 constitute an organic photosensitive layer.

The inorganic protective layer 5 is a gallium oxide layer.

An electrophotographic photoreceptor 7B illustrated in FIG. 2 is a function-separated photoreceptor in which the function is separated between the charge generating layer 2 and the charge transporting layer 3 as in the electrophotographic photoreceptor 7A illustrated in FIG. 1. The function of the charge transporting layer 3 is further separated. An electrophotographic photoreceptor 7C illustrated in FIG. 3 is of a type in which a charge generating material and a charge transporting material are contained in the same layer (single-layer organic photosensitive layer 6 (charge generating/charge transporting layer)).

In the electrophotographic photoreceptor 7B illustrated in FIG. 2, an undercoat layer 1 is disposed on a conductive substrate 4, and a charge generating layer 2, a charge transporting layer 3B, a charge transporting layer 3A, and an inorganic protective layer 5 are sequentially stacked on the undercoat layer 1. In the electrophotographic photoreceptor 7B, the charge transporting layer 3A, the charge transporting layer 3B, and the charge generating layer 2 constitute an organic photosensitive layer.

The inorganic protective layer 5 is a gallium oxide layer.

In the electrophotographic photoreceptor 7C illustrated in FIG. 3, an undercoat layer 1 is disposed on a conductive substrate 4, and a single-layer organic photosensitive layer 6 and an inorganic protective layer 5 are sequentially stacked on the undercoat layer 1.

The inorganic protective layer 5 is a gallium oxide layer.

In the electrophotographic photoreceptors illustrated in FIGS. 1 to 3, the undercoat layer 1 is optional.

In the description below, individual components of the electrophotographic photoreceptor 7A illustrated in FIG. 1 are described as a representative example. In the description below, reference symbols may be omitted.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steels etc.), and paper sheets, resin films, and belts having coatings formed by application, vapor deposition, or laminating using conductive compounds (for example, conductive polymers and indium oxide), metals (for example, aluminum, palladium, and gold), or alloys. The term "conductive" means that the volume resistivity is less than $10^{13}$ Ωcm.

When the electrophotographic photoreceptor is to be used in a laser printer, the surface of the conductive substrate may be roughened to a center-line-average roughness Ra of 0.04 μm or more and 0.5 μm or less in order to suppress interference fringes during laser beam irradiation. When an incoherent light is used as a light source, roughening is not particularly needed for the purpose of preventing interference fringes but may be performed to obtain a longer service life since defects caused by irregularities on the surface of the conductive substrate are reduced.

Examples of the roughening method include wet honing that involves spraying a suspension of an abrasive in water onto a supporting body, centerless grinding that involves continuously grinding the conductive substrate by pressing the conductive substrate against a rotating grinding stone, and anodization.

Another example of a method for obtaining a rough surface involves forming a layer containing a resin and dispersed conductive or semi-conductive particles on a surface of the conductive substrate so that the particles dispersed in the layer create roughness. According to this method, the surface of the conductive substrate is not directly roughened.

Roughening by anodization involves conducting anodization by using a metal (e.g., aluminum) conductive substrate as the anode in an electrolytic solution so as to form an oxide film on the surface of the conductive substrate. Examples of the electrolytic solution include a sulfuric acid solution and an oxalic acid solution. However, the anodized film formed by anodization is porous, and is thus chemically active and susceptible to contamination as is. Moreover, the resistance thereof fluctuates depending on the environment. Thus the porous anodized film may be subjected to a pore sealing treatment with which the fine pores of the oxide film are sealed by volume expansion caused by hydration reaction in compressed steam or boiling water (a metal salt such as a nickel salt may be added) so as to convert the oxide into a more stable hydrous oxide.

The thickness of the anodized film may be, for example, 0.3 μm or more and 15 μm or less. When the thickness is in this range, the anodized film has a tendency of exhibiting a barrier property against injection. Moreover, the increase in residual potential due to repeated use tends to be suppressed.

The conductive substrate may be treated with an acidic treatment solution or subjected to a Boehmite treatment.

The treatment with an acidic treatment solution is, for example, carried out as follows. First, an acidic treatment solution containing phosphoric acid, chromic acid, and hydrofluoric acid is prepared. The blend ratios of phosphoric acid, chromic acid, and hydrofluoric acid in the acidic treatment solution are, for example, phosphoric acid: 10% by weight or more and 11% by weight or less, chromic acid: 3% by weight or more and 5% by weight or less, and hydrofluoric acid: 0.5% by weight or more and 2% by weight or less. The total acid concentration may be 13.5% by weight or more and 18% by weight or less. The treatment temperature may be, for example, 42° C. or higher and 48° C. or lower. The thickness of the coating film may be 0.3 μm or more and 15 μm or less.

The Boehmite treatment is conducted, for example, by immersing the conductive substrate in pure water at 90° C. or higher and 100° C. or lower for 5 minutes to 60 minutes or bringing the conductive substrate into contact with hot compressed steam at 90° C. or higher and 120° C. or lower for 5 minutes to 60 minutes. The thickness of the film may be 0.1 or more and 5 μm or less. The resulting conductive substrate may be further subjected to an anodization treatment by using an electrolytic solution that has a low film dissolving power, such as adipic acid, boric acid, borate, phosphate, phthalate, maleate, benzoate, tartrate, or citrate.

Undercoat Layer

The undercoat layer is, for example, a layer that contains inorganic particles and a binder resin.

Examples of the inorganic particles include those having a powder resistance (volume resistivity) of $10^2$ Ωcm or more and $10^{11}$ Ωcm or less.

Examples of the inorganic particles having such a resistance value include metal oxide particles such as tin oxide particles, titanium oxide particles, zinc oxide particles, and zirconium oxide particles. Zinc oxide particles may be used as the inorganic particles.

The Brunauer-Emmett-Teller (BET) specific surface area of the inorganic particles may be, for example, 10 $m^2/g$ or more.

The volume-average particle size of the inorganic particles may be, for example, 50 nm or more and 2000 nm or less, or 60 nm or more and 1000 nm or less.

The inorganic particle content relative to, for example, the binder resin may be 10% by weight or more and 80% by weight or less or may be 40% by weight or more and 80% by weight or less.

The inorganic particles may have treated surfaces. A mixture of two or more types of inorganic particles subjected different surface treatments or having different particle sizes may be used.

Examples of the surface treatment agent include a silane coupling agent, a titanate coupling agent, an aluminum coupling agent, and a surfactant. In particular, a silane coupling agent or, to be more specific, an amino-containing silane coupling agent may be used.

Examples of the amino-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination. For example, a combination of an amino-containing silane coupling agent and another silane coupling agent may be used. Examples of this another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method using the surface treatment agent may be any known method and may be a wet method or a dry method.

The amount of the surface treatment agent used may be 0.5% by weight or more and 10% by weight or less relative to the inorganic particles, for example.

The undercoat layer may contain an electron accepting compound (acceptor compound) as well as inorganic particles. This is because long-term stability of electric properties and the carrier blocking property are enhanced.

Examples of the electron accepting compounds include electron transporting substances such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

A compound having an anthraquinone structure may be used as the electron-accepting compound. Examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron accepting compound may be co-dispersed with the inorganic particles in the undercoat layer. Alternatively, the electron accepting compound may be attached to the surfaces of the inorganic particles and contained in the undercoat layer.

A method for causing the electron accepting compound to attach to the surfaces of the inorganic particles may be a dry method or a wet method.

According to a dry method, for example, while inorganic particles are stirred with a mixer or the like having a large shear force, an electron accepting compound as is or dissolved in an organic solvent is dropped or sprayed along with dry air or nitrogen gas so as to cause the electron accepting compound to attach to the surfaces of the inorganic particles. When the electron accepting compound is dropped or sprayed, the temperature may be not higher than the boiling point of the solvent. After the electron accepting compound is dropped or sprayed, baking may be further conducted at 100° C. or higher. Baking may be conducted at any temperature for any amount of time as long as electrophotographic properties are obtained.

According to a wet method, while inorganic particles are dispersed in a solvent through stirring or by using ultrasonic waves, a sand mill, an attritor, a ball mill, or the like, an electron accepting compound is added thereto and the resulting mixture is stirred or dispersed, followed by removal of the solvent to cause the electron accepting compound to attach to the surfaces of the inorganic particles. The solvent is removed by, for example, filtration or distillation. After removal of the solvent, baking may be conducted at 100° C. or higher. Baking may be conducted at any temperature for any amount of time as long as electrophotographic properties are obtained. In the wet method, the water contained in the inorganic particles may be removed prior to adding the electron accepting compound. For example, water may be removed by stirring the inorganic particles in a solvent under heating or azeotropically with the solvent.

The electron accepting compound may be attached to the inorganic particles before, after, or at the same time as treating the surface with a surface treatment agent.

The electron accepting compound content relative to, for example, the inorganic particles may be 0.01% by weight or more and 20% by weight or less, or 0.01% by weight or more and 10% by weight or less.

Examples of the binder resin used in the undercoat layer include known polymer materials such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; and other known materials such as zirconium chelate compounds, titanium chelate compounds, aluminum chelate compounds, titanium alkoxide compounds, organic titanium compounds, and silane coupling agents.

Other examples of the binder resin used in the undercoat layer include a charge transporting resin having a charge transporting group and a conductive resin (e.g., polyaniline).

Among these, a resin insoluble in the coating solvent contained in the overlying layer may be used as the binder resin contained in the undercoat layer. Examples thereof include thermosetting resins such as urea resins, phenolic resins, phenol-formaldehyde resins, melamine resins, urethane resins, unsaturated polyester resins, alkyd resins, and epoxy resins; and resins obtained by reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin.

When two or more of these binder resins are used in combination, the mixing ratio is set as desired.

The undercoat layer may contain various additives that improve electrical properties, environmental stability, and image quality.

Examples of the additives include known materials such as electron transporting pigments based on fused polycyclic and azo materials, zirconium chelate compounds, titanium chelate compounds, aluminum chelate compounds, titanium alkoxide compounds, organic titanium compounds, and silane coupling agents. Although a silane coupling agent is used in a surface treatment of inorganic particles as discussed above, it may also be added to the undercoat layer as an additive.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, zirconium acetylacetonate butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butylate, diethylacetoacetate aluminum diisopropylate, and aluminum tris(ethyl acetoacetate).

These additives may be used alone or as a mixture or a polycondensation product of two or more compounds.

The undercoat layer may have a Vickers hardness of 35 or more.

The surface roughness (ten-point average roughness) of the undercoat layer may be adjusted to 1/(4n) (n: refractive index of overlying layer) to ½ of the exposure laser wavelength λ in order to suppress moire images.

Resin particles and the like may be added to the undercoat layer to adjust the surface roughness. Examples of the resin particles include silicone resin particles and crosslinked polymethyl methacrylate resin particles. The surface of the undercoat layer may be polished to adjust the surface roughness. Examples of the polishing method include buff polishing, sand blasting, wet honing, and grinding.

The undercoat layer may be formed by any known method. For example, a coating solution for forming an undercoat layer may be prepared by adding the above-described components to a solvent, forming a coating film by using this coating solution, drying the coating film, and, if needed, heating the coating film.

Examples of the solvent used to prepare the coating solution for forming an undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples of these solvents include ordinary organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the coating solution for forming an undercoat layer include known methods that use a roll mill, a ball mill, a vibrating ball mill, an attritor, a sand mill, a colloid mill, and a paint shaker.

Examples of the method for applying the coating solution for forming an undercoat layer onto the conductive substrate include known methods such as a blade coating method, a wire bar coating method, a spray coating method, a dip coating method, a bead coating method, an air knife coating method, and a curtain coating method.

The thickness of the undercoat layer may be set to 15 μm or more, or may be set to 20 μm or more and 50 μm or less.

Intermediate Layer

An intermediate layer may be formed between the undercoat layer and the photosensitive layer although this is not illustrated in the drawings.

The intermediate layer is, for example, a layer that contains a resin. Examples of the resin contained in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound contained in the intermediate layer include organic metal compounds containing metal atoms such as zirconium, titanium, aluminum, manganese, and silicon atoms.

These compounds to be contained in the intermediate layer may be used alone or as a mixture or a polycondensation product of two or more compounds.

The intermediate layer may be a layer that contains an organic compound that contains a zirconium atom or a silicon atom, in particular.

The intermediate layer may be formed by any known method. For example, a coating solution for forming the intermediate layer may be prepared by adding the above-described components to a solvent and applied to form a coating film, and the coating film may be dried and, if desired, heated.

Examples of the method for applying the solution for forming the intermediate layer include known methods such as a dip coating method, a lift coating method, a wire bar coating method, a spray coating method, a blade coating method, a knife coating method, and a curtain coating method.

The thickness of the intermediate layer is, for example, set within the range of 0.1 μm or more and 3 μm or less. The intermediate layer may be used as an undercoat layer.

Charge Generating Layer

The charge generating layer is a layer that contains a charge generating material and a binder resin, for example. The charge generating layer may be a layer formed by vapor deposition of a charge generating material. The vapor deposited layer of the charge generating material is suitable when an incoherent light source such as a light-emitting diode (LED) or an organic electro-luminescence (EL) image array is used as the light source.

Examples of the charge generating material include azo pigments such as bisazo and trisazo pigments; fused aromatic pigments such as dibromoanthanthrone; perylene pigments; pyrrolopyrrole pigments; phthalocyanine pigments; zinc oxide; and trigonal selenium.

Among these, a metal phthalocyanine pigment or a metal-free phthalocyanine pigment may be used as the charge generating material in order to allow use of near infrared laser exposure. Specific examples thereof include hydroxygallium phthalocyanine, chlorogallium phthalocyanine, dichlorotin phthalocyanine, and titanyl phthalocyanine.

In order to allow use of near-ultraviolet laser exposure, the charge generating material may be a fused aromatic pigment such as dibromoanthanthrone, a thioindigo pigment, a porphyrazine compound, zinc oxide, trigonal selenium, or a bisazo pigment, for example.

The above-described charge generating material may be used in the case where an incoherent light source, such as an LED or organic EL image array, having an emission center wavelength in the range of 450 nm or more and 780 nm or less is used. However, when the photosensitive layer is as thin as 20 μm or less to improve resolution, the field strength in the photosensitive layer increases and electrification resulting from charge injection from the substrate decreases, thereby readily generating image defects known as black spots. This phenomenon is notable when a charge generating material, such as trigonal selenium or a phthalocyanine pigment, that is a p-type semiconductor and readily generates dark current is used.

In contrast, when an n-type semiconductor such as a fused aromatic pigment, a perylene pigment, or an azo pigment is used as the charge generating material, dark current rarely occurs and fewer image defects called black spots occur despite a small thickness.

Whether the semiconductor is n-type or not is determined by a typical time-of-flight technique and by the polarity of photoelectric current flowing therein. A semiconductor that allows electrons rather than holes to flow as a carrier is assumed to be the n-type.

The binder resin used in the charge generating layer is selected from a wide variety of insulating resins. The binder resin may be selected from organic photoconductive polymers such as poly-N-vinylcarbazole, polyvinyl anthracene, polyvinyl pyrene, and polysilane.

Examples of the binder resin include polyvinyl butyral resins, polyarylate resins (polycondensation products of bisphenols and aromatic divalent carboxylic acids, etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" means that the volume resistivity is $10^{13}$ Ωcm or more.

These binder resins may be used alone or as a mixture or two or more.

The blend ratio of the charge generating material to the binder resin may be within the range of 10:1 to 1:10 on a weight basis.

The charge generating layer may contain other known additives.

The charge generating layer may be formed by any known method. For example, a charge generating layer-forming coating solution may be prepared by adding the above-described components to a solvent and applied to form a coating film, and the coating film may be dried and, if desired, heated. The charge generating layer may also be formed by vapor deposition of a charge generating material. Formation of the charge generating layer by vapor deposition may be employed when a fused aromatic pigment or a perylene pigment is used as the charge generating material.

Examples of the solvent for preparing the charge generating layer-forming coating solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or as a mixture of two or more.

The technique for dispersing particles (for example, a charge generating material) in the charge generating layer-forming coating solution includes those which use a medium disperser such as a ball mill, a vibrating ball mill, an attritor, a sand mill, or a horizontal sand mill, and a medium-less disperser such as an agitator, an ultrasonic disperser, a roll mill, and a high-pressure homogenizer. Examples of the high-pressure homogenizers include collision-type homogenizers with which a dispersion is dispersed under a high pressure through liquid-liquid collision or liquid-wall collision, or a penetration-type homogenizer with which a material is caused to penetrate through narrow channels under a high pressure.

In conducting dispersion, it is effective to control the average particle size of the charge generating material in the charge generating layer-forming coating solution to 0.5 μm or less, 0.3 μm or less in some cases, or 0.15 μm or less in some cases.

Examples of the technique of applying the charge generating layer-forming coating solution onto the undercoat layer (or intermediate layer) include typical techniques such as a blade coating technique, a wire bar coating technique, a spray coating technique, a dip coating technique, a bead coating technique, an air knife coating technique, and a curtain coating technique.

The thickness of the charge generating layer may be, for example, 0.1 μm or more and 5.0 μm or less, or may be 0.2 μm or more and 2.0 μm or less.

Charge Transporting Layer

A charge transporting layer is a layer that contains, for example, a charge transporting material and a binder resin. The charge transporting layer may be a layer that contains a polymer charge transporting material.

Examples of the charge transporting material include quinone-based compounds such as p-benzoquinone, chloranil, bromanil, and anthraquinone; tetracyanoquinodimethane-based compounds; fluorenone compounds such as 2,4,7-trinitrofluorenone; xanthone-based compounds; benzophenone-based compounds; cyanovinyl-based compounds; and ethylene-based compounds. Examples of hole transporting compounds that may be used as the charge transporting material include triarylamine-based compounds, benzidine-based compounds, aryl alkane-based compounds, aryl-substituted ethylene-based compounds, stilbene-based compounds, anthracene-based compounds, and hydrazone-based compounds. These charge transporting materials are non-limiting examples and may be used alone or in combination.

From the viewpoint of charge mobility, the charge transporting material may be a triarylamine derivative represented by structural formula (a-1) below or a benzidine derivative represented by structural formula (a-2) below.

(a-1)

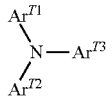

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituents of the groups described above include a halogen atom, an alkyl group having 1 to 5 carbon atoms, and an alkoxy group having 1 to 5 carbon atoms. A substituted amino group substituted with an alkyl group having 1 to 3 carbon atoms may also be used as the substituent for the groups described above.

(a-2)

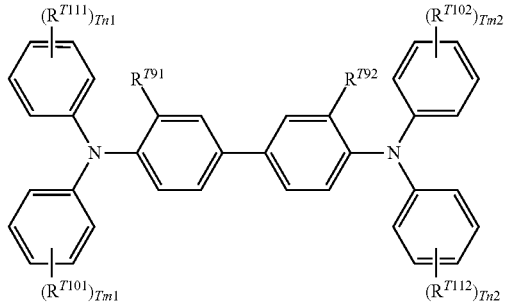

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$. $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. $Tm_1$, $Tm_2$, $Tn_1$, and $Tn_2$ each independently represent an integer of 0 or more and 2 or less.

Examples of the substituents of the groups described above include a halogen atom, an alkyl group having 1 to 5 carbon atoms, and an alkoxy group having 1 to 5 carbon atoms. A substituted amino group substituted with an alkyl group having 1 to 3 carbon atoms may also be used as the substituent of the group.

Among the triarylamine derivatives represented by structural formula (a-1) and benzidine derivatives represented by structural formula (a-2), triarylamine derivatives having "$—C_6H_4—CH=CH—CH=C(R^{T7})(R^{T8})$" and benzidine derivatives having "$—CH=CH—CH=C(R^{T15})(R^{T26})$" may be used from the viewpoint of charge mobility.

Charge transporting materials that are commonly available such as poly-N-vinyl carbazole and polysilane are used as the polymer charge transporting material. Specifically, polyester-based polymer charge transporting materials may be used. The polymer charge transporting material may be used alone or in combination with a binder resin.

Examples of the binder resin used in the charge transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins and polyarylate resins are particularly suitable as the binder resins. These binder resins are used alone or in combination.

The charge transporting material-binder resin blend ratio may be 10:1 to 1:5 in terms of weight.

Among these binder resins described above, from the viewpoint of easily decreasing the surface roughness of the charge transporting layer and further suppressing occurrence of image deletion, polycarbonate resins (homopolymer types such as bisphenol A, bisphenol Z, bisphenol C, and bisphenol TP and copolymer types thereof) may be used. The polycarbonate resins may be used alone or in combination. From the same viewpoint, a homopolymer-type polycarbonate resin of bisphenol Z is particularly suitable among the polycarbonate resins.

The charge transporting layer may contain a charge transporting material and a binder resin, and if needed, silica particles.

When the charge transporting layer (in other words, the outermost layer of the organic photosensitive layer) contains silica particles, cracking of the inorganic protective layer is suppressed. Specifically, whereas an organic photosensitive layer tends to have flexibility and a tendency to deform, an inorganic protective layer is hard and has a tendency to have poor toughness. Thus, for example, when mechanical load is applied by a member (for example, an intermediate transfer body) in contact with an outer peripheral surface of a photoreceptor and the organic photosensitive layer serving as an undercoat layer of the inorganic protective layer undergoes deformation, the inorganic protective layer may crack. By adding silica particles to the layer that constitutes the surface of the organic photosensitive layer, the silica particles function as a reinforcer for the organic photosensitive layer. As a result, deformation of the organic photosensitive layer may be avoided and cracking of the inorganic protective layer may be suppressed.

The silica particle content relative to the entire charge transporting layer may be 30% by weight or more, 40% by weight or more, or 50% by weight or more in order to suppress cracking of the inorganic protective layer. The upper limit of the silica particle content is not particularly limited and may be 70% by weight or less, 65% by weight or less, or 60% by weight or less in order to maintain properties of the charge transporting layer, etc.

Examples of the silica particles include dry process silica particles and wet process silica particles.

Examples of the dry process silica particles include pyrogenic silica (fumed silica) obtained by burning silane compounds and deflagration silica obtained by deflagrating metal silicon powder.

Examples of the wet process silica particles include wet silica particles obtained by neutralization reaction between sodium silicate and mineral acid (precipitated silica synthesized and aggregated under alkaline conditions and gel silica particles synthesized and aggregated under acidic conditions), colloidal silica particles obtained by alkalinizing and polymerizing acidic silicates (silica sol particles), and sol-gel silica particles obtained by hydrolysis of organic silane compounds (for example, alkoxy silane).

Among these, pyrogenic silica particles having fewer silanol groups at the surface and a low-porosity structure may be used from the viewpoint of suppressing image defects (suppressing degradation of thin line reproducibility) caused by generation of residual potential and other degradation of electrical properties.

The volume-average particle size of the silica particles is, for example, 20 nm or more and 200 nm or less, or may be 40 nm or more and 150 nm or less, 50 nm or more and 120 nm or less, or 50 nm or more and 110 nm or less.

When the silica particles having a volume-average particle size within the above-described range and a binder resin having a viscosity-average molecular weight less than 50,000 are used in combination, the surface roughness of the charge transporting layer does not decrease easily and occurrence of the image deletion is more easily suppressed.

The volume-average particle size of the silica particles is measured by separating silica particles from the layer, observing 100 primary particles of the silica particles with a scanning electron microscope (SEM) at a magnification of 40,000, measuring the longest axis and the shortest axis of each particle by image analysis of the primary particles, determining the equivalent circle diameter from the intermediate value, determining a 50% diameter (D50v) from the cumulative frequency of the obtained equivalent circle diameters, and assuming the result to be the volume-average particle size of the silica particles.

The silica particles may be surface-treated with a hydrophobing agent. The surface treatment decreases the number of silanol groups on the surfaces of the silica particles and tends to suppress generation of residual potential.

Examples of the hydrophobing agent include common silane compounds such as chlorosilane, alkoxysilane, and silazane.

Among these, a silane compound having a trimethylsilyl group, a decylsilyl group, or a phenylsilyl group may be used from the viewpoint of ease of suppressing generation of residual potential. In other words, the surfaces of the silica particles may have trimethylsilyl groups, decylsilyl groups, or phenylsilyl groups.

Examples of the silane compound having a trimethylsilyl group include trimethylchlorosilane, trimethylmethoxysilane, and 1,1,1,3,3,3-hexamethyldisilazane.

Examples of the silane compound having a decylsilyl group include decyltrichlorosilane, decyldimethylchlorosilane, and decyltrimethoxysilane.

Examples of the silane compound having a phenylsilyl group include triphenylmethoxysilane and triphenylchlorosilane.

The condensation ratio of the hydrophobized silica particles (the ratio of Si—O—Si in $SiO_4$— bonds in the silica particles, hereinafter, this ratio is also referred to as a "hydrophobing agent condensation ratio") is, for example, 90% or more, may be 91% or more, or may be 95% or more relative to the silanol groups on the surfaces of the silica particles.

When the hydrophobing agent condensation ratio is within the above-described range, the number of silanol groups on the silica particles is further decreased and generation of residual potential is more easily suppressed.

The hydrophobing agent condensation ratio indicates the ratio of condensed silicon atoms to all sites capable of bonding to silicon atoms in the condensed portions detected by nuclear magnetic resonance (NMR) and is measured as follows.

First, silica particles are separated from the layer. The separated silica particles are subjected to Si CP/MAS NMR analysis with AVANCE III 400 produced by Bruker to determine the peak areas according to the number of substituted SiO. The values for disubstituted ($Si(OH)_2(O—Si)_2$—), trisubstituted ($Si(OH)(O—Si)_3$—), and tetrasubstituted ($Si(O—Si)_4$—) segments are respectively assumed to be Q2, Q3, and Q4. The hydrophobing agent condensation ratio is given by formula $(Q2\times2+Q3\times3+Q4\times4)/4\times(Q2+Q3+Q4)$.

The volume resistivity of the silica particles is, for example, $10^{11}$ Ω·cm or more, and may be $10^{12}$ Ω·cm or more or $10^{13}$ Ω·cm or more.

When the volume resistivity of the silica particles is within the above-described range, degradation of electrical properties is suppressed.

The volume resistivity of the silica particles is measured as follows. The measurement environment has a temperature of 20° C. and a humidity of 50% RH.

First, silica particles are separated from the layer. The separated silica particles which are the measurement object are placed on a surface of a circular jig equipped with a 20 $cm^2$ electrode plate in such a manner that the thickness of a layer formed by the silica particles is about 1 mm or more and about 3 mm or less. An identical 20 $cm^2$ electrode plate is placed on the silica particle layer so as to sandwich the silica particle layer with the electrode plates. In order to eliminate voids between the silica particles, a load of 4 kg is applied on the electrode plate placed on the silica particle layer and then the thickness (cm) of the silica particle layer is measured. The two electrode plates sandwiching the hydrophobic silica particle layer are connected to an electrometer and a high-voltage power generator. A high voltage is applied to the two electrodes so that a predetermined electric field is created and the value (A) of the current flowing at that time is measured to calculate the volume resistivity (Ω·cm) of the silica particles. The calculation formula for the volume resistivity (Ω·cm) of the silica particles is as follows:

$$\rho=E\times20/(I-I_0)/L$$

where ρ represents a volume resistivity (Ω·cm) of silica particles, E represents an applied voltage (V), I represents a current value (A), $I_0$ represents a current value (A) at an applied voltage of 0 V, and L represents a thickness (cm) of the silica particle layer. In evaluation, the volume resistivity at an applied voltage of 1,000 V is used.

The charge transporting layer may contain known additives in addition to the above-described components.

The charge transporting layer may be formed by any known method and no limitations are imposed. For example, a charge transporting layer-forming coating solution prepared by adding a solvent to the above-described components may be applied to form a coating film and the coating film may be dried and if needed heated.

Examples of the solvent used in preparing the charge transporting layer-forming coating solution include common organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic and straight-chain ethers such as tetrahydrofuran and ethyl ether. These solvents may be used alone or in combination as a mixture.

Examples of the technique of applying the charge transporting layer-forming coating solution to a charge generating layer include common techniques such as a blade coating technique, a wire bar coating technique, a spray coating technique, a dip coating technique, a bead coating technique, an air knife coating technique, and a curtain coating technique.

When particles (for example, silica particles or fluororesin particles) are to be dispersed in a charge transporting layer-forming coating solution, the dispersing method may use a medium disperser such as a ball mill, a vibrating ball mill, an attritor, a sand mill, or a horizontal sand mill, or a medium-less disperser such as an agitator, an ultrasonic disperser, a roll mill, or a high-pressure homogenizer, for example. Examples of the high-pressure homogenizers include collision-type homogenizers with which a dispersion is dispersed under a high pressure through liquid-liquid collision or liquid-wall collision, or a penetration-type homogenizer with which a material is caused to penetrate through narrow channels under a high pressure.

Properties of Charge Transporting Layer

The surface roughness Ra (arithmetic average surface roughness Ra) of the inorganic protective layer-side surface of the charge transporting layer is, for example, 0.06 μm or less and may be 0.03 μm or less in some cases or 0.02 μm or less in some cases.

When the surface roughness Ra is within this range, the flatness and smoothness of the inorganic protective layer are improved and the cleaning property is improved.

The surface roughness Ra may be controlled to be in the above-described range by increasing the thickness of the layer, for example.

The surface roughness Ra is measured as follows.

First, the inorganic protective layer is separated and the layer to be measured is exposed. Then a portion of that layer is cut out with a cutter or the like to obtain a measurement sample.

The measurement sample is analyzed with a probe-type surface roughness meter (SURFCOM 1400A produced by TOKYO SEIMITSU CO., LTD.). The measurement conditions are in compliance with Japanese Industrial Standards (JIS) B 0601-1994, namely, evaluation length Ln=4 mm, sampling length L=0.8 mm, and cutoff value=0.8 mm.

The elastic modulus of the charge transporting layer is, for example, 5 GPa or more and may be 6 GPa or more in some cases and 6.5 GPa or more in some cases.

When the elastic modulus of the charge transporting layer is within this range, generation of recessed portions and cracking of the inorganic protective layer are easily suppressed.

In order to adjust the elastic modulus of the charge transporting layer to be in the above-mentioned range, the silica particle size and/or silica particle content may be adjusted or the type and content of the charge transporting material may be adjusted, for example.

The elastic modulus of the charge transporting layer is measured as follows.

First, the inorganic protective layer is separated and the layer to be measured is exposed. Then a portion of that layer is cut out with a cutter or the like to obtain a measurement sample.

The measurement sample is analyzed with Nano Indenter SA2 produced by MTS Systems Corporation and a depth profile is obtained by a continuous stiffness measurement (CSM) (U.S. Pat. No. 4,848,141). The average of the values observed in the indentation depth range of 30 nm to 100 nm is used.

The thickness of the charge transporting layer is, for example, 10 μm or more and 40 μm or less, and may be 10 or more and 35 μm or less in some cases or 15 μm or more and 30 μm or less in some cases.

When the thickness of the charge transporting layer is within this range, cracking of the inorganic protective layer and generation of residual potential are easily suppressed.

Inorganic Protective Layer

The inorganic protective layer is disposed on the outer peripheral surface of the organic photosensitive layer and is a gallium oxide layer that contains at least gallium and oxygen, and, if needed, elements other than gallium and oxygen.

Volume Resistivity of Inorganic Protective Layer

The inorganic protective layer of the photoreceptor according to the first exemplary embodiment has a volume resistivity of $6.0\times10^{7}$ Ω·cm or more and $4.0\times10^{8}$ Ω·cm or less or about $6.0\times10^{7}$ Ω·cm or more and about $4.0\times10^{8}$ Ω·cm or less in both the inner region and the outer region.

The inorganic protective layer of the photoreceptor according to the second exemplary embodiment may have a volume resistivity in the above-described range in both the inner region and the outer region.

In the present exemplary embodiment, at least one of the inner region and the outer region of the inorganic protective layer may have a volume resistivity of $1.0\times10^{8}$ Ω·cm or more and $4.0\times10^{8}$ Ω·cm or less or about $1.0\times10^{8}$ Ω·cm or more and about $4.0\times10^{8}$ Ω·cm or less.

The volume resistivity of the inner region of the inorganic protective layer and the volume resistivity of the outer region of the inorganic protective layer are determined by measuring the resistance values with LCR meter ZM2371 produced by NF Corporation at a frequency of 1 kHz and a voltage of 1 V and calculating the volume resistivity from the measured resistance value, the electrode area, and the sample thickness.

The measurement sample may be a sample prepared by depositing a film on an aluminum substrate under the same conditions as those for forming the inorganic protective layer to be measured and forming a gold electrode on the deposited layer by vacuum vapor deposition. Alternatively, the measurement sample may be a sample prepared by separating the inorganic protective layer from an already prepared electrophotographic photoreceptor, etching the separated inorganic protective layer as needed, and sandwiching the etched inorganic protective layer between a pair of electrodes.

Specifically, a sample used for measuring the volume resistivity of the inner region is, for example, obtained by forming an inorganic protective layer having a thickness of 0.2 μm under the same conditions for forming the inner region of the inorganic protective layer to be measured. Alternatively, a sample used for measuring the volume resistivity of the inner region is obtained by etching the outer peripheral surface side of the inorganic protective layer separated from an already prepared electrophotographic photoreceptor so as to leave the inner region having a thickness of 0.2 μm on the inner peripheral surface side.

A sample used for measuring the volume resistivity of the outer region is, for example, obtained by forming a film on an aluminum substrate under the same conditions as those for forming the inorganic protective layer to be measured except that no source gas is supplied until the time to start deposition of the outer region comes and that source gas is supplied only during deposition of the outer region. Alternatively, a sample used for measuring the volume resistivity of the outer region is obtained by etching the inner peripheral surface side of the inorganic protective layer removed from an already prepared photoreceptor so as to leave the outer region having a thickness of 0.2 μm on the outer peripheral surface side.

In the present exemplary embodiment, the volume resistivity of the inorganic protective layer as a whole may be $6.0\times10^{7}$ Ω·cm or more and $4.0\times10^{8}$ Ω·cm or less. In some cases, the volume resistivity of the inorganic protective layer as a whole may be $1.0\times10^{8}$ Ω·cm or more and $4.0\times10^{8}$ Ω·cm or less or about $1.0\times10^{8}$ Ω·cm or more and about $4.0\times10^{8}$ Ω·cm or less.

The volume resistivity of the inorganic protective layer as a whole is obtained by measuring the whole inorganic protective layer that spans from the inner peripheral surface to the outer peripheral surface by the same method as one for measuring the volume resistivity of the inner region and the volume resistivity of the outer region described above.

Optical Absorption Edge Energy of Inorganic Protective Layer

The inorganic protective layer of the photoreceptor according to the second exemplary embodiment has an optical absorption edge energy of 2.00 eV or more and 2.60 eV or less in both the inner region and the outer region.

The inorganic protective layer of the photoreceptor according to the first exemplary embodiment may also have an optical absorption edge energy within the above-described range in both the inner region and the outer region.

In the present exemplary embodiment, at least one of the inner region and the outer region of the inorganic protective layer may have an optical absorption edge energy of 2.10 eV or more and 2.30 eV or less.

The optical absorption edge energy in the inner region of the inorganic protective layer and the optical absorption edge energy in the outer region of the inorganic protective layer are obtained by measuring the absorption spectrum of a region of the inorganic protective layer to be measured, and converting the wavelength of the optical absorption edge at which the absorption coefficient is $1\times10^6$ $m^{-1}$ into energy (eV).

The measurement sample may be a sample prepared by forming a film on a quartz substrate under the same conditions as forming the inorganic protective layer to be measured or may be a sample prepared by separating the inorganic protective layer from the manufactured photoreceptor and etching the inorganic protective layer as needed.

The method for obtaining samples used for measuring the optical absorption edge energy of the inner region and the optical absorption edge energy of the outer region is the same as the method for obtaining a sample used for measuring the volume resistivity of the inner region or the outer region.

In the present exemplary embodiment, the optical absorption edge energy of the inorganic protective layer as a whole may be 2.00 eV or more and 2.60 eV.

The optical absorption edge energy of the inorganic protective layer as a whole is obtained by measuring the whole inorganic protective layer that spans from the inner peripheral surface to the outer peripheral surface by the same method as that for measuring the optical absorption edge energy of the inner region and the optical absorption edge energy of the outer region described above.

Composition of Inorganic Protective Layer

The inorganic protective layer of the photoreceptor according to the present exemplary embodiment contains at least gallium and oxygen, and may further contain other elements as needed.

The element composition ratio (oxygen/gallium) of oxygen to gallium in the inorganic protective layer that contains gallium and oxygen (gallium oxide layer) is, for example, 1.0 or more but less than 1.5.

As the element composition ratio (oxygen/gallium) increases, less oxygen defect occur and thus the volume resistivity of the gallium oxide layer increases. As the element composition ratio (oxygen/gallium) decreases, charge migration is enhanced due to oxygen defect and thus the volume resistivity exhibits a decreasing tendency.

Thus, in the first exemplary embodiment, in order to control the volume resistivity to $6.0\times10^7$ Ω·cm or more and $4.0\times10^8$ Ω·cm or less in both the inner region and the outer region, the element composition ratio (oxygen/gallium) in both the inner region and the outer region may be 1.03 or more and 1.47 or less, 1.05 or more and 1.45 or less, or 1.10 or more and 1.40 or less.

As the element composition ratio (oxygen/gallium) increases, the absorption region shifts toward the short wavelength side and thus the gallium oxide layer exhibits high optical absorption edge energy. As the element composition ratio (oxygen/gallium) decreases, the absorption region shifts toward the longer wavelength side and thus the optical absorption edge energy exhibits a decreasing tendency.

Thus, in the second exemplary embodiment, in order to control the optical absorption edge energy to 2.00 eV or more and 2.60 eV or less in both the inner region and the outer region, the element composition ratio (oxygen/gallium) in both the inner region and the outer region may be 1.03 or more and 1.47 or less, 1.05 or more and 1.45 or less, or 1.10 or more and 1.40 or less.

In sum, the inorganic protective layer of the photoreceptor of the present exemplary embodiment has an element composition ratio (oxygen/gallium) within the above-described range in both the inner region and the outer region. The difference in this ratio between the two regions is small.

The element composition ratio (oxygen/gallium) of the inorganic protective layer as a whole may also be 1.03 or more and 1.47 or less, 1.05 or more and 1.45 or less, or 1.10 or more and 1.40 or less from the viewpoint of controlling the volume resistivity of the inorganic protective layer as a whole and the optical absorption edge energy of the inorganic protective layer as a whole to be within the above-described ranges.

The inorganic protective layer may contain hydrogen in addition to gallium and oxygen from the viewpoint of ease of controlling various physical properties.

In order to control the conductivity type, the inorganic protective layer may contain at least one element selected from the group consisting of C, Si, Ge, and Sn for the n-type or may contain at least one element selected from the group consisting of N, Be, Mg, Ca, and Sr for the p-type.

The sum of the element constituent ratios of gallium, oxygen, and hydrogen relative to all the elements constituting the entire inorganic protective layer may be 90 at % or more. When the total of the element constituent ratios of these elements is 90 at % or more and when group 15 elements, such as N, P, and As, have accidentally mixed in, the influence of these elements bonding to gallium is reduced, for example. Thus, the optimum range of the oxygen-gallium composition ratio (oxygen/gallium) that can improve hardness and electrical properties of the inorganic protective layer is easily found.

The sum of the element constituent ratios may be 95 at % or more, 96 at % or more, or 97 at % or more from this viewpoint.

When the inorganic protective layer is composed of gallium, oxygen, and, if needed, hydrogen, the optimum element constituent ratios of the inorganic protective layer as a whole from the viewpoint of excellent mechanical strength, light-transmitting properties, flexibility, and conduction controllability is as follows.

The element constituent ratio of gallium relative to all elements constituting the inorganic protective layer is, for example, 15 at % or more and 50 at % or less, may be 20 at % or more and 40 at % or less, or may be 20 at % or more and 30 at % or less.

The element constituent ratio of oxygen relative to all elements constituting the inorganic protective layer is, for example, 30 at % or more and 70 at % or less, may be 40 at % or more and 60 at % or less, or may be 45 at % or more and 55 at % or less.

The element constituent ratio of hydrogen relative to all elements constituting the inorganic protective layer is, for example, 10 at % or more and 40 at % or less, may be 15 at % or more and 35 at % or less, or may be 20 at % or more and 30 at % or less.

The element constituent ratio in the entire inner region as and the element constituent ratio in the entire outer region may be in the above-described range.

The element constituent ratios, ratios of the numbers of atoms, etc., of the respective elements in the whole inorganic protective layer, the whole inner region, and the whole outer region, and their distributions in the thickness direction are determined by Rutherford back-scattering (RBS).

In RBS, 3SDH Pelletron produced by National Electrostatics Corporation (NEC) is used as an accelerator, RBS-400 (produced by CE&A Co., Ltd.) is used as an endstation, and 3S-R10 is used as a system. A HYPRA program produced by CE&A Co., Ltd., and the like are used in the analysis.

The RBS measurement conditions are as follows: He++ ion beam energy: 2.275 eV, detection angle: 160°, grazing angle relative to incident beam: about 109°.

RBS measurement is conducted as follows.

First, a He++ ion beam is applied perpendicular to the sample and a detector is positioned at an angle of 160° with respect to the ion beam to measure the signals of backscattered He. The energy and strength of the detected He determine the composition ratio and the film thickness. The spectrum may be measured at two detection angles in order to improve accuracy of determining the composition ratio and film thickness. Conducting measurement at two detection angles having different depth-direction resolution and backscattering dynamics and performing cross-checking improve accuracy.

The number of the He atoms backscattered by the target atoms is determined only from the three factors, namely, 1) the atomic number of the target atom, 2) energy of He atoms before scattering, and 3) scattering angle.

The density is predicted from the detected composition through calculation and the thickness is determined by using the density. The margin of error in determining the density is within 20%.

The constituent ratio of hydrogen is determined as follows by hydrogen forward scattering (hereinafter referred to as "HFS").

In HFS measurement, 3SDH Pelletron produced by National Electrostatics Corporation (NEC) is used as an accelerator, RBS-400 produced by CE&A Co., Ltd., is used as an endstation, and 3S-R10 is used as a system. A HYPRA program produced by CE&A Co., Ltd., and the like are used in the analysis. The HFS measurement conditions are as follows:

He++ ion beam energy: 2.275 eV, detection angle: 160°, and grazing angle with respect to incident beam: 30°.

In the HFS measurement, the detector is positioned at 30° with respect to the He++ ion beam and the sample is positioned at 75° with respect to the normal line so as to pick up signals of hydrogen scattered forward out of the sample. During this process, the detector may be covered with an aluminum foil to remove the He atoms scattering with hydrogen. Quantitative determination is conducted by normalizing the hydrogen counts of the reference samples and the measured sample by a stopping power and then comparing the normalized counts. A sample formed of Si and H ion-implanted in Si and white mica are used as the reference samples.

White mica is known to have a hydrogen concentration of 6.5 atom %.

The hydrogen count is corrected by subtracting the number of H atoms adhering to the clean Si surface, for example, so as to count out H adhering to the outermost surface.

Properties of Inorganic Protective Layer

The inorganic protective layer may be a non-single-crystal film such as a microcrystalline film, a polycrystalline film, or an amorphous film. An amorphous film may be used since it has a smooth and flat surface or a microcrystalline may be used from the viewpoint of hardness.

A growth section of the inorganic protective layer may have a columnar structure. From the viewpoint of slidability, the growth section may have a highly flat structure and thus may be amorphous.

Crystallinity and amorphousness are determined by the presence or absence of spots and lines in diffraction diagrams obtained by reflection high energy electron diffraction (RHEED) measurement.

The elastic modulus of the inorganic protective layer is 30 GPa or more and 80 GPa or less and may be 40 GPa or more and 65 GPa or less.

When the elastic modulus is within this range, generation of nicks (dents), cracking, and separation in the inorganic protective layer are likely to be suppressed.

The elastic modulus is determined by using Nano Indenter SA2 produced by MTS Systems Corporation by continuous stiffness measurement (CSM) (U.S. Pat. No. 4,848,141) to obtain a depth profile, and calculating the average from the values observed at an indent depth of 30 nm to 100 nm. The measurement conditions are as follows: Measurement environment: 23° C., 55% RH Indenter used: regular triangle pyramid indenter made of diamond (Berkovich indenter) Testing Mode: CSM Mode The measurement sample may be a sample prepared by forming a film on a substrate under the same conditions as those for forming the inorganic protective layer to be measured, or may be a sample prepared by separating the inorganic protective layer from an already prepared electrophotographic photoreceptor and partially etching the separated inorganic protective layer.

The thickness of the inorganic protective layer as a whole is, for example, 0.4 μm or more and 10.0 μm or less, or may be 1.0 μm or more and 5.0 μm or less.

If the inorganic protective layer has a large thickness as a whole, the difference between the volume resistivity of the inner region and the volume resistivity of the outer region is likely to be large. When the difference is large, it is difficult to achieve, at a high level, keeping scratches on the outer peripheral surface of the inorganic protective layer from appearing in the image and suppressing image deletion. However, in the first exemplary embodiment, since the volume resistivity is within the above-described range in both the inner region and the outer region, keeping scratches on the outer peripheral surface of the inorganic protective layer from appearing in the image and suppressing image deletion are achieved at a high level despite a large thickness of the inorganic protective layer as a whole.

Likewise, when the thickness of the inorganic protective layer as a whole is large, the difference between the optical absorption edge energy of the inner region and the optical absorption edge energy of the outer region is likely to be large. When the difference is large, it is difficult to achieve, at a high level, keeping scratches on the outer peripheral surface of the inorganic protective layer from appearing in the image and keeping the high sensitivity of the photoreceptor. However, in the second exemplary embodiment, since the optical absorption edge energy is within the above-described range in both the inner region and the outer region, keeping scratches on the outer peripheral surface of the inorganic protective layer from appearing in the image and keeping the high sensitivity of the photoreceptor are achieved at a high level despite a large thickness of the inorganic protective layer as a whole.

Formation of Inorganic Protective Layer

Examples of the technique used to form the inorganic protective layer include commonly vapor phase film-forming techniques such as a plasma chemical vapor deposition (CVD) technique, a metalorganic chemical vapor deposition technique, a molecular beam epitaxy technique, vapor deposition, and sputtering.

For example, a plasma CVD technique may be used to form the inorganic protective layer.

In plasma CVD, films are deposited at a low temperature (for example, 150° C. or lower) compared to when a thermal CVD or the like is used. Thus, damage on the organic photosensitive layer by heat is reduced by using the plasma CVD technique.

When the inorganic protective layer is formed by a plasma CVD technique, the substrate temperature (the temperature of the conductive substrate on which the organic photosensitive layer is formed) rises with time due to plasma, and less and less oxygen is incorporated into the film as the substrate temperature rises. When deposition is continued without changing film-forming conditions such as the amount of oxygen supplied, a film in which the element composition ratio (oxygen/gallium) in the region remote from the substrate (or the organic photosensitive layer formed on the conductive substrate) is smaller than the element composition ratio (oxygen/gallium) in the region close to the substrate is likely to be obtained.

Examples of the method for forming a gallium oxide layer in which the difference between the element composition ratio (oxygen/gallium) in the inner region and the element composition ratio (oxygen gallium) in the outer region is small, such as the inorganic protective layer of the photoreceptor of the present exemplary embodiment, are as follows.

A first example is a method with which the amount of oxygen supplied is increased with the increase in substrate temperature. As a result, despite changes in substrate temperature, the decrease in the amount of oxygen incorporated into the film is suppressed, and the difference in element composition ratio (oxygen/gallium) between the inner region and the outer region is decreased.

A second example is the method with which discharging is temporarily discontinued when the substrate temperature rises due to film deposition and exceeds a preset temperature and is then resumed when the substrate temperature decreases due to discontinuation of discharging and falls below a preset temperature, and this cycle is repeated. As a result, the change in substrate temperature is directly suppressed, the decrease in the amount of oxygen incorporated into the film is suppressed, and the difference in the element composition ratio (oxygen/gallium) between the inner region and the outer region is decreased.

As a result, changes in the composition are suppressed, and a gallium oxide layer in which the difference in the element composition ratio (oxygen/gallium) between the inner region and the outer region is small is obtained.

Formation of the inorganic protective layer will now be described by using a specific example and referring to the drawings that illustrate examples of a film forming device. In the description below, a method for forming an inorganic protective layer composed of gallium, oxygen and hydrogen is described; however, the method is not limited to this. Any known film-forming method may be employed according to the composition of the inorganic protective layer desired.

Figure 4A:
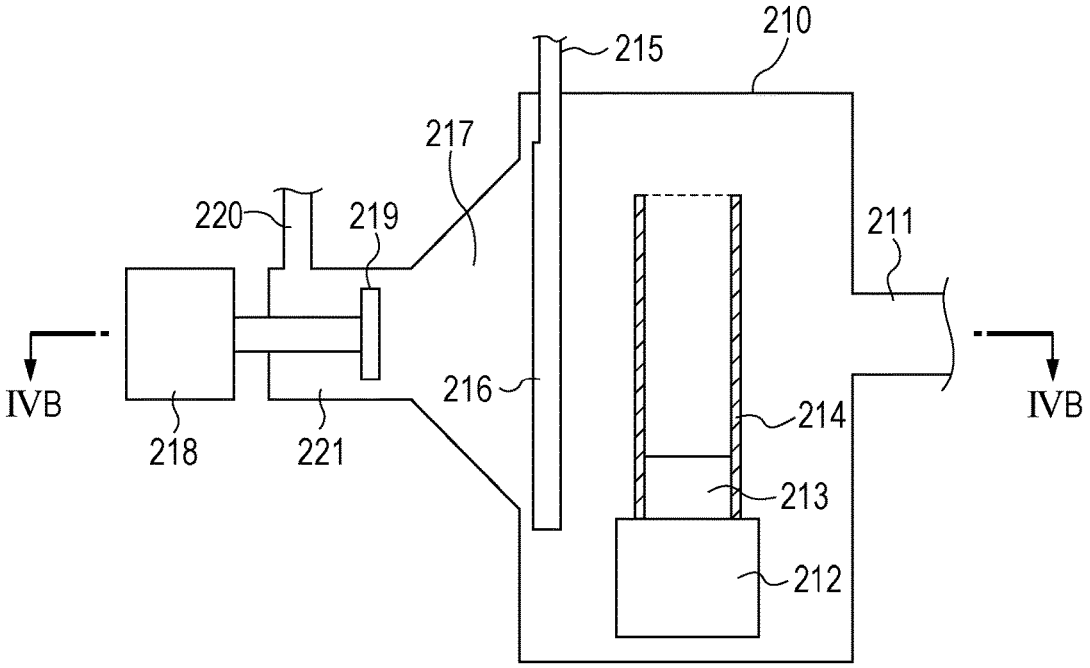
FIGS. 4A and 4B are schematic diagrams illustrating one example of a film forming device used in forming an inorganic protective layer of the electrophotographic photoreceptor according to the exemplary embodiment.
Figure 4B:
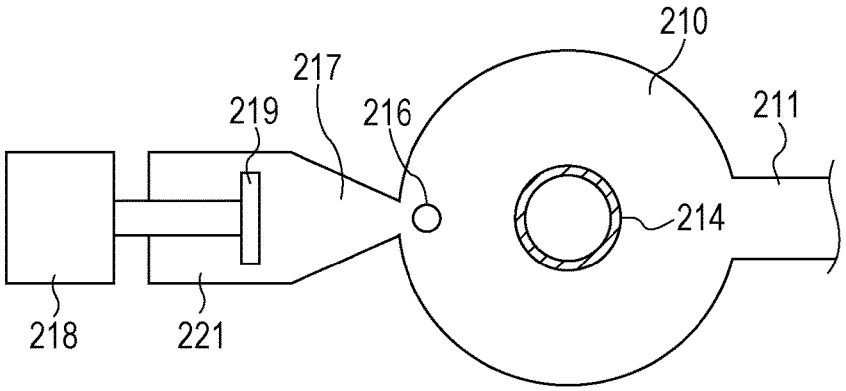

FIGS. 4A and 4B are schematic diagrams illustrating one example of a film forming device used in forming the inorganic protective layer of the electrophotographic photoreceptor according to the present exemplary embodiment. FIG. 4A is a schematic cross-sectional view of the film forming device viewed from a side surface. FIG. 4B is a schematic cross-sectional view of the film forming device taken along line IVB-IVB in FIG. 4A. In FIGS. 4A and 4B, reference numeral 210 denotes a deposition chamber, 211 denotes an exhaust, 212 denotes a substrate rotating unit, 213 denotes a substrate supporting unit, 214 denotes a substrate, 215 denotes a gas inlet duct, 216 denotes a shower nozzle having an opening through which gas introduced from the gas inlet duct 215 is injected, 217 denotes a plasma diffusing unit, 218 denotes a high-frequency power supply unit, 219 denotes a plate electrode, 220 denotes a gas inlet duct, and 221 denotes a high-frequency discharge tube.

In the film forming device illustrated in FIGS. 4A and 4B, the exhaust 211 connected to a vacuum evacuator not illustrated in the drawing is provided at one end of the deposition chamber 210. A plasma generator that includes the high-frequency power supply unit 218, the plate electrode 219, and the high-frequency discharge tube 221 is provided to the deposition chamber 210 on the side opposite to where the exhaust 211 is installed.

This plasma generator includes the high-frequency discharge tube 221, the plate electrode 219 installed within the high-frequency discharge tube 221 and having a discharge surface positioned on the exhaust 211 side, and the high-frequency power supply unit 218 disposed outside the high-frequency discharge tube 221 and connected to a surface of the plate electrode 219 opposite of the discharge surface. The gas inlet duct 220 through which gas is supplied to the interior of the high-frequency discharge tube 221 is connected to the high-frequency discharge tube 221, and the other end of the gas inlet duct 220 is connected to a first gas supply source not illustrated in the drawings.

Figure 5:
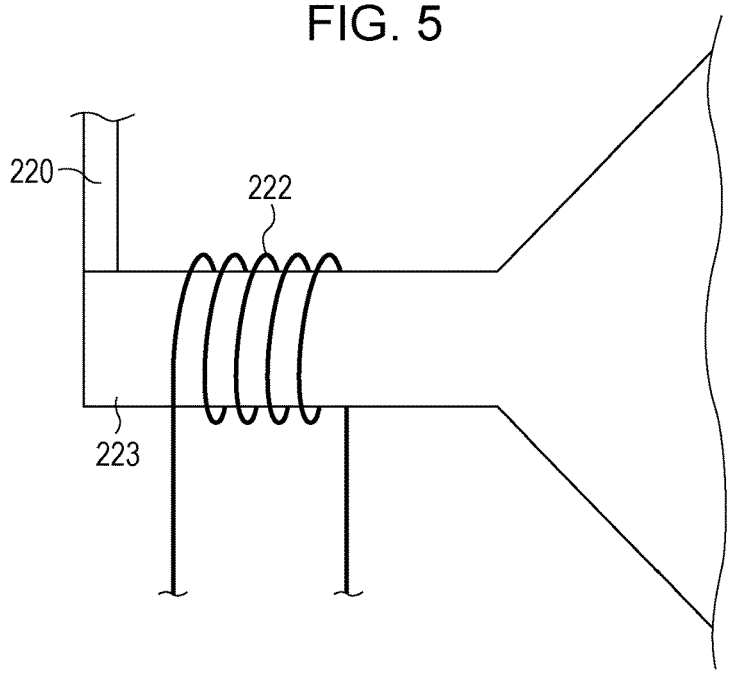
FIG. 5 is a schematic diagram illustrating an example of a plasma generator used in forming the inorganic protective layer of the electrophotographic photoreceptor according to the exemplary embodiment.

Instead of the plasma generator in the film forming device illustrated in FIGS. 4A and 4B, a plasma generator illustrated in FIG. 5 may be used. FIG. 5 is a schematic diagram illustrating another example of the plasma generator used in the film forming device illustrated in FIGS. 4A and 4B. FIG. 5 is a side view of the plasma generator. In FIG. 5, reference numeral 222 denotes a high-frequency coil, 223 denotes a quartz tube, and 220 is the same as the one illustrated in FIGS. 4A and 4B. The plasma generator includes the quartz tube 223 and the high-frequency coil 222 disposed along the outer peripheral surface of the quartz tube 223. One end of the quartz tube 223 is connected to the deposition chamber 210 (not illustrated in FIG. 5). The other end of the quartz tube 223 is connected to the gas inlet duct 220 through which gas is introduced to the interior of the quartz tube 223.

Referring to FIGS. 4A and 4B, the shower nozzle 216 having a rod shape and extending along the discharge surface of the plate electrode 219 is connected to the discharge surface side of the plate electrode 219, and one end of the shower nozzle 216 is connected to the gas inlet duct 215. The gas inlet duct 215 is connected to a second gas supply source (not illustrated in the drawings) disposed outside the deposition chamber 210.

The substrate rotating unit 212 is installed in the deposition chamber 210. The substrate 214 has a cylindrical shape and is loadable onto the substrate rotating unit 212 through the substrate supporting unit 213 so that the substrate 214 faces the shower nozzle 216 in such a manner that the longitudinal direction of the shower nozzle 216 coincides with the axial direction of the substrate 214. During film deposition, the substrate rotating unit 212 rotates so as to turn the substrate 214 in the circumferential direction. An example of the substrate 214 is a photoreceptor that includes layers up to an organic photosensitive layer formed in advance.

The inorganic protective layer is formed as follows, for example.

First, oxygen gas (or helium (He)-diluted oxygen gas), helium (He) gas, and optionally hydrogen ($H_2$) gas are introduced to the interior of the high-frequency discharge tube 221 through the gas inlet duct 220, and at the same time, a 13.56 MHz radio wave is supplied to the plate electrode 219 from the high-frequency power supply unit 218. During this process, the plasma diffusing unit 217 that spreads radially from the discharge surface side of the plate electrode 219 toward the exhaust 211 is formed. The gas introduced from the gas inlet duct 220 flows in the deposition chamber 210 from the plate electrode 219 side toward the exhaust 211 side. The plate electrode 219 may be surrounded by an earth shield.

Next, trimethyl gallium gas is introduced into the deposition chamber 210 through the gas inlet duct 215 and the shower nozzle 216 located downstream of the plate electrode 219, which serves as an activating unit, so as to form a non-single-crystal film containing gallium, oxygen, and hydrogen on the surface of the substrate 214.

For example, a substrate on which an organic photosensitive layer is formed is used as the substrate 214.

The surface of the substrate 214 during deposition of the inorganic protective layer is 150° C. or lower and may be 100° C. or lower because an organic photoreceptor that has an organic photosensitive layer is used. The temperature of the surface may be 30° C. or higher and 100° C. or lower, or 50° C. or higher and 90° C. or lower.

As discussed above, the surface temperature of the substrate 214 may rise to a high level due to plasma. Thus, the temperature of the surface of the substrate 214 may be controlled by using a heating unit, a cooling unit, or the like, although this is not illustrated in the drawings. Alternatively, the temperature of the surface may be left to rise naturally during discharging. To heat the substrate 214, a heater may be installed on the inner side or outer side of the substrate 214. To cool the substrate 214, gas or liquid for cooling may be circulated on the inner side of the substrate 214.

Instead of trimethyl gallium gas, an organic metal compound containing aluminum or a hydride such as diborane may be used. Two or more of these may be used as a mixture.

For example, in the initial stage of forming an inorganic protective layer, trimethyl indium may be introduced into the deposition chamber 210 through the gas inlet duct 215 and the shower nozzle 216 so as to form a film containing nitrogen and indium on the substrate 214. In such a case, this film absorbs ultraviolet rays that are generated during the subsequent film deposition and that deteriorate the organic photosensitive layer. As a result, damage onto the organic photosensitive layer inflicted by generation of ultraviolet rays during film deposition is suppressed.

In order to perform doping with a dopant during film deposition, $SiH_3$ or $SnH_4$ in a gas state is used for n-type doping, and biscyclopentadienylmagnesium, dimethyl calcium, dimethyl strontium, or the like in a gas state is used for p-type doping. In order to dope the surface layer with dopant atoms, a commonly used technique, such as a thermal diffusion technique or an ion implantation technique, may be employed.

Specifically, for example, gas containing at least one dopant atoms is introduced into the deposition chamber 210 through the gas inlet duct 215 and the shower nozzle 216 so as to obtain an inorganic protective layer having a particular conductivity type such as n-type or p-type.

In the film forming devices illustrated in FIGS. 4A, 4B, and 5, active nitrogen or active hydrogen formed by discharge energy may be independently controlled by providing multiple activating devices. Alternatively, gas simultaneously containing nitrogen atoms and hydrogen atoms, such as $NH_3$, may be used. Furthermore, $H_2$ may be added. Conditions that generate free active hydrogen from the organic metal compound may be employed.

As a result, activated carbon atoms, gallium atoms, nitrogen atoms, hydrogen atoms, and the like are present on the surface of the substrate 214 in a controlled manner. The activated hydrogen atoms have an effect of inducing desorption of hydrogen atoms in a molecular form from hydrocarbon groups such as methyl and ethyl groups constituting the organic metal compound.

Thus, a hard film (inorganic protective layer) constituting three-dimensional bonds is formed.

The plasma generators of the film forming devices illustrated in FIGS. 4A, 4B, and 5 each use a high-frequency oscillator; however, the plasma generator is not limited to this. For example, a microwave oscillator, an electrocyclotron resonance plasma source, or a helicon plasma source may be used. The high-frequency oscillator may be of an induction type or a capacitance type.

Two or more of these devices of different types may be used in combination, or two or more devices of the same type may be used in combination. A high-frequency oscillator may be used to suppress the increase in temperature of the surface of the substrate 214. Alternatively, a device that suppresses heat radiation may be provided.

When two or more plasma generators (plasma generating units) of different types are used, adjustment may be made so that discharge is induced simultaneously at the same pressure. There may be a difference in pressure between the region where discharge is conducted and the region where deposition is conducted (region where the substrate is loaded). These devices may be arranged in series relative to the gas flow that flows from the portion where the gas is introduced to the portion where the gas is discharged in the film forming device. Alternatively, the devices may be arranged so that all of the devices face the deposition surface of the substrate.

For example, when two types of plasma generators are arranged in series relative to the gas flow in a film forming device illustrated in FIGS. 4A and 4B, the shower nozzle 216 serves as an electrode and is used as a second plasma generator that induces discharge in the deposition chamber 210. In such a case, for example, a high-frequency voltage is applied to the shower nozzle 216 through the gas inlet duct 215 so that discharge occurs in the deposition chamber 210 by using the shower nozzle 216 as an electrode. Alternatively, instead of using the shower nozzle 216 as an electrode, a cylindrical electrode is provided between the substrate 214 and the plate electrode 219 in the deposition chamber 210 and the cylindrical electrode is used to induce discharge in the deposition chamber 210.

When two different types of plasma generators are used at the same pressure, for example, when a microwave oscillator and a high-frequency oscillator are used, the excitation energies of the excitation species are markedly changed, which is effective for controlling the quality of the film. Discharge may be conducted at about an atmospheric pressure (70,000 Pa or more and 110,000 Pa or less). Helium (He) may be used as carrier gas in conducting discharge at about atmospheric pressure.

By using the film forming devices illustrated in FIGS. 4A, 4B, and 5, the inorganic protective layer is formed by, for example, placing a substrate 214, on which an organic photosensitive layer is formed, in the deposition chamber 210 and introducing mixed gas of different compositions to form an inorganic protective layer.

When high-frequency discharge is to be conducted, for example, the frequency may be adjusted to be in the range of 10 kHz or more and 50 MHz or less in order to form a high-quality film at low temperature. The output depends on the size of the substrate 214 and may be in the range of 0.01 $W/cm^2$ or more and 0.2 $W/cm^2$ or less relative to the surface area of the substrate. The rotation speed of the substrate 214 may be in the range of 0.1 rpm or more and 500 rpm or less.

Examples of other film-forming conditions include the flow rate of gas, discharge output, pressure of the deposition chamber, and the substrate temperature. By adjusting these conditions, the composition of the inorganic protective layer is controlled.

The method for decreasing the difference between the element composition ratio (oxygen/gallium) in the inner region and the element composition ratio (oxygen/gallium) in the outer region is as described above.

In the description above, an example of an electrophotographic photoreceptor in which the photosensitive layer is a separated function-type organic photosensitive layer and the charge transporting layer is of a single layer type is described. However, this is not limiting.

For example, an electrophotographic photoreceptor illustrated in FIG. 2 is a photoreceptor in which the organic photosensitive layer is of a separated function type and the charge transporting layer is of a multilayer type. The electrophotographic photoreceptor illustrated in FIG. 2 includes a charge transporting layer 3A in contact with the inorganic protective layer 5 and a charge transporting layer 3B not in contact with the inorganic protective layer 5 instead of the charge transporting layer 3 of the electrophotographic photoreceptor illustrated in FIG. 1.

One example of the electrophotographic photoreceptor illustrated in FIG. 2 includes a charge transporting layer similar to a known charge transporting layer in which the charge transporting layer 3A contains a charge transporting material, a binder resin, and silica particles and the charge transporting layer 3B contains a charge transporting material and a binder resin but not silica particles.

The charge transporting layer 3A may have a thickness of 1 μm or more and 15 μm or less. The charge transporting layer 3B may have a thickness of 15 μm or more and 29 μm or less.

The electrophotographic photoreceptor illustrated in FIG. 3 includes a single-layer-type organic photosensitive layer. The electrophotographic photoreceptor illustrated in FIG. 3 has a single-layer organic photosensitive layer 6 instead of the charge generating layer 2 and the charge transporting layer 3 of the electrophotographic photoreceptor illustrated in FIG. 1.

The single-layer organic photosensitive layer 6 (charge generating/charge transporting layer) may have the same structure as the charge transporting layer 3 of the electrophotographic photoreceptor illustrated in FIG. 1 except for inclusion of the charge generating material.

However, the charge generating material content in the single-layer organic photosensitive layer 6 relative to the entire single-layer organic photosensitive layer may be 25% by weight or more and 50% by weight or less.

The single-layer organic photosensitive layer 6 may have a thickness of 15 μm or more and 30 μm or less.

Image Forming Apparatus and Process Cartridge

An image forming apparatus according to an exemplary embodiment includes an electrophotographic photoreceptor, a charging unit that charges a surface of the electrophotographic photoreceptor, an electrostatic latent image forming unit that forms an electrostatic latent image on a charged surface of the electrophotographic photoreceptor, a developing unit that develops the electrostatic latent image on the surface of the electrophotographic photoreceptor by using a developer that contains a toner so as to form a toner image, and a transfer unit that transfers the toner image onto a surface of a recording medium. The electrophotographic photoreceptor according to the present exemplary embodiment described above is used as this electrophotographic photoreceptor.

The image forming apparatus according to an exemplary embodiment is used to implement an image forming method (an image forming method according to an exemplary embodiment) that includes a charging step of charging a surface of an electrophotographic photoreceptor, an electrostatic latent image forming step of forming an electrostatic latent image on a charged surface of the electrophotographic photoreceptor, a developing step of developing an electrostatic latent image formed on the surface of the electrophotographic photoreceptor by using a developer that contains a toner so as to form a toner image, and a transfer step of transferring the toner image onto a surface of a recording medium.

The image forming apparatus according to the exemplary embodiment is applicable to known image forming apparatuses such as an apparatus equipped with a fixing device that fixes a toner image transferred onto a surface of a recording medium, a direct-transfer-type apparatus configured to directly transfer a toner image formed on a surface of an electrophotographic photoreceptor onto a recording medium, an intermediate-transfer-type apparatus configured to transfer a toner image formed on a surface of an electrophotographic photoreceptor onto a surface of an intermediate transfer body (first transfer) and then transfer the toner image on the surface of the intermediate transfer body onto a surface of a recording medium (second transfer), an apparatus equipped with a charge erasing device that irradiates a surface of an electrophotographic photoreceptor with a charge erasing beam after transfer of a toner image and before charging so as to erase charges, an apparatus equipped with a charge erasing unit that applies charge-erasing light to a surface of the electrophotographic photoreceptor after transfer of the toner image and before charging so as to erase charges, and an apparatus equipped with an electrophotographic photoreceptor-heating member configured to increase the temperature of an electrophotographic photoreceptor and decrease the relative temperature.

For an intermediate-transfer-type apparatus, the transfer device includes, for example, an intermediate transfer body having a surface onto which a toner image is transferred, a first transfer device configured to transfer a toner image on a surface of the electrophotographic photoreceptor onto a surface of the intermediate transfer body, and a second transfer device configured to transfer the toner image on the surface of the intermediate transfer body onto a surface of a recording medium.

The image forming apparatus according to the exemplary embodiment may be of a dry development type or a wet development type (development type that uses a liquid developer).

In the image forming apparatus of the exemplary embodiment, for example, the section equipped with an electrophotographic photoreceptor may have a cartridge configuration (process cartridge) attachable to and detachable from the image forming apparatus. The process cartridge may be one equipped with the electrophotographic photoreceptor according to the exemplary embodiment. The process cartridge may include, in addition to the electrophotographic photoreceptor, at least one selected from the group consisting of a charging unit, an electrostatic latent image forming unit, a developing unit, and a transfer unit.

One non-limiting example of an image forming apparatus according to the exemplary embodiment will now be described. Only the relevant components illustrated in the drawings are described and descriptions of other components are omitted.

Figure 6:
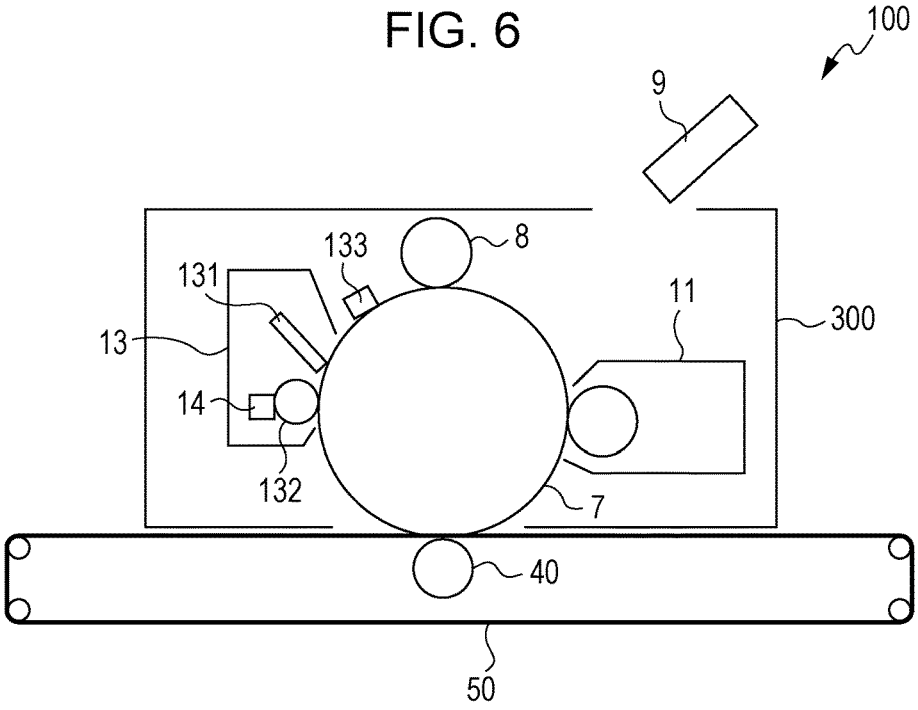
FIG. 6 is a schematic diagram illustrating an example of an image forming apparatus according to an exemplary embodiment.

FIG. 6 is a schematic diagram illustrating an example of an image forming apparatus according to an exemplary embodiment.

An image forming apparatus 100 according to the exemplary embodiment includes, as shown in FIG. 6, a process cartridge 300 that includes an electrophotographic photoreceptor 7; an exposing device 9 (one example of the electrostatic latent image forming unit); a transfer device 40 (first transfer device); and an intermediate transfer body 50. In the image forming apparatus 100, the exposing device 9 is positioned so that the electrophotographic photoreceptor 7 can be exposed through an opening of the process cartridge 300. The transfer device 40 is positioned to oppose the electrophotographic photoreceptor 7 with the intermediate transfer body 50 therebetween. The intermediate transfer body 50 is positioned so that a portion thereof is in contact with the electrophotographic photoreceptor 7. Although not illustrated in the drawing, a second transfer device that transfers the toner image on the intermediate transfer body 50 onto a recording medium (for example, paper sheet) is also included in the apparatus. The intermediate transfer body 50, the transfer device 40 (first transfer device), and the second transfer device (not illustrated) is an example of the transfer unit.

The process cartridge 300 illustrated in FIG. 6 includes a housing that integrally supports the electrophotographic photoreceptor 7, a charging device 8 (one example of the charging unit), a developing device 11 (one example of the developing unit), and a cleaning device 13 (one example of the cleaning unit). The cleaning device 13 includes a cleaning blade (one example of a cleaning member) 131. The cleaning blade 131 is arranged to come into contact with a surface of the electrophotographic photoreceptor 7. The cleaning member may be a conductive or insulating fibrous member instead of or used in combination with the cleaning blade 131.

In FIG. 6, an image forming apparatus equipped with a fibrous member 132 (roll shaped) that supplies a lubricant 14 to the surface of the electrophotographic photoreceptor 7, and a fibrous member 133 (flat brush shaped) that assists cleaning is illustrated as an example. These components are provided as needed.

An image forming operation by using the image forming apparatus 100 will now be described.

First, the surface of the rotating electrophotographic photoreceptor 7 is charged with the charging device 8. The exposing device 9 exposes the charged surface of the electrophotographic photoreceptor 7 on the basis of the image information. As a result, an electrostatic latent image corresponding to the image information is formed on the electrophotographic photoreceptor 7. In the developing device 11, the electrostatic latent image formed on the surface of the electrophotographic photoreceptor 7 is developed with a developer containing a toner. As a result, a toner image is formed on the surface of the electrophotographic photoreceptor 7. The toner image formed on the surface of the electrophotographic photoreceptor 7 is transferred onto the intermediate transfer body 50. The toner image on the intermediate transfer body 50 is transferred onto a recording medium by using a second transfer device not illustrated in the drawing. The toner image on the recording medium is fixed with a fixing device not shown in the drawing. The surface of the electrophotographic photoreceptor 7 after transfer of the toner image is cleaned with the cleaning device 13.

The structures of the image forming apparatus according to the exemplary embodiment will now be described.

Charging Device

Examples of the charging device 8 include contact-type chargers that use conductive or semi-conductive charging rollers, charging brushes, charging films, charging rubber blades, and charging tubes; and non-contact-type chargers known in the art such as non-contact-type roller chargers and scorotron chargers and corotron chargers that use corona discharge.

Exposing Device

An example of the exposing device 9 is an optical device that illuminates the surface of the electrophotographic photoreceptor 7 by light from a semiconductor laser, an LED, or a liquid crystal shutter so as to form an intended light image on the surface. The wavelength of the light source is to be within the region of the spectral sensitivity of the electrophotographic photoreceptor. The mainstream semiconductor lasers are infrared lasers having an oscillation wavelength around 780 nm. The wavelength is not limited to this, and a laser that has an oscillation wavelength on the order of 600 nm or a blue laser that has an oscillation wavelength of 400 nm or more and 450 nm or less may also be used. A surface-emission type laser light source capable of outputting a multibeam is effective for forming color images.

Developing Device

An example of the developing device 11 is a typical developing device that conducts development by using a developer in a contact or non-contact manner. The developing device 11 may be any device that has this function and is selected according to the purpose. An example thereof is a known developing device that has a function of causing a one-component or two-component developer to attach to the electrophotographic photoreceptor 7 by using a brush, a roller, or the like. In particular, the developing device may use a development roller that retains the developer on the surface thereof.

The developer used in the developing device 11 may be a one-component developer formed of a toner alone or may be a two-component developer formed of a toner and a carrier. The developer may be magnetic or non-magnetic. Known developers may be used as the developer.

Cleaning Device

A cleaning blade-type system equipped with the cleaning blade 131 is used as the cleaning device 13.

In addition to the cleaning blade system, a fur brush cleaning system or development-cleaning simultaneous system may be used in combination.

Transfer Device

Examples of the transfer device 40 include various known transfer chargers such as contact-type transfer chargers that use a belt, a roller, a film, a rubber blade, or the like, and scorotron transfer charges and corotron transfer chargers that utilize corona discharge.

Intermediate Transfer Body

Examples of the intermediate transfer body 50 include belt-shaped intermediate transfer bodies (intermediate transfer belts) that contain semi-conductive polyimide, polyamide imide, polycarbonate, polyarylate, polyester, rubber, and the like. The intermediate transfer body may have a belt shape or a drum shape.

Figure 7:
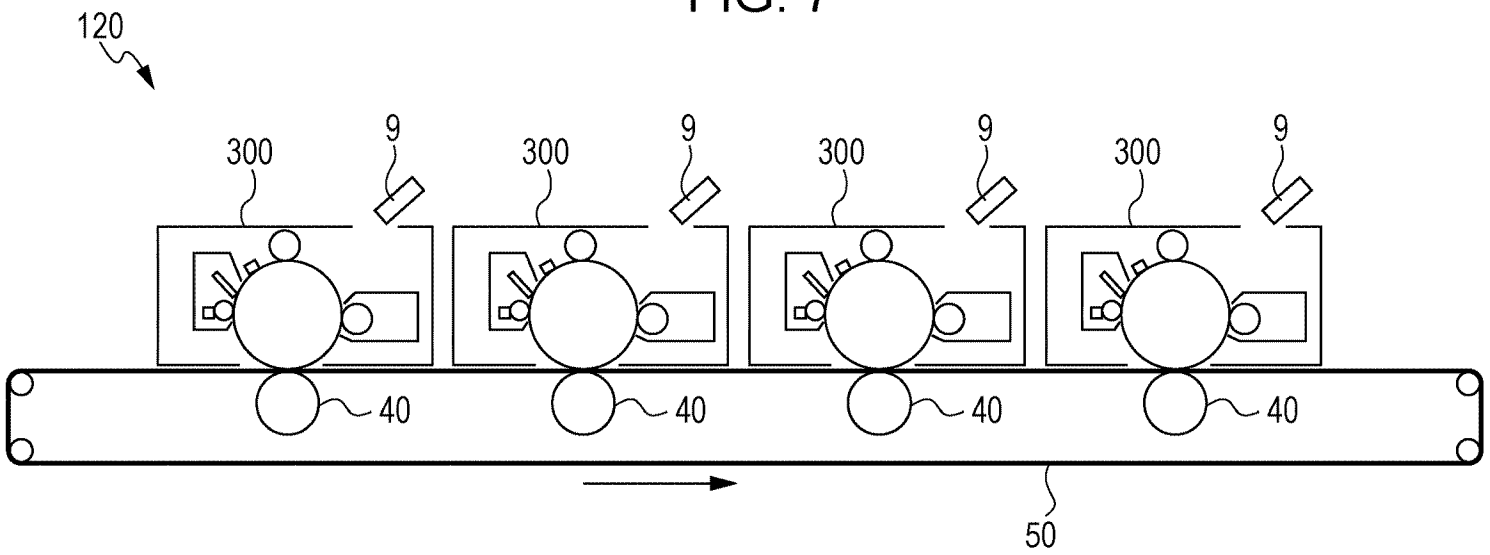
FIG. 7 is a schematic diagram illustrating another example of an image forming apparatus according to an exemplary embodiment.

FIG. 7 is a schematic diagram illustrating another example the an image forming apparatus according to the exemplary embodiment.

An image forming apparatus 120 illustrated in FIG. 7 is a tandem-system multicolor image forming apparatus equipped with four process cartridges 300. In the image forming apparatus 120, four process cartridges 300 are arranged side-by-side on the intermediate transfer body 50 and one electrophotographic photoreceptor is used for one color. The image forming apparatus 120 has a structure identical to the image forming apparatus 100 except for that image forming apparatus 120 has a tandem system.

The image forming apparatus 100 according to the exemplary embodiment is not limited to one having the structure described above. For example, a first charge erasing device that aligns polarity of the residual toner so as to facilitate removal of the toner with a cleaning brush may be provided near the electrophotographic photoreceptor and at a position downstream of the transfer device 40 in the rotation direction of the electrophotographic photoreceptor 7 and upstream of the cleaning device 13 in the rotating direction of the electrophotographic photoreceptor 7. Furthermore, a second charge erasing device that erases charges from the surface 7 of the electrophotographic photoreceptor 7 may be provided downstream of the cleaning device 13 in the rotation direction of the electrophotographic photoreceptor and upstream of the charging device 8 in the rotating direction of the electrophotographic photoreceptor.

The structure of the image forming apparatus 100 according to the exemplary embodiment is not limited by the above-described structures. For example, the image forming apparatus 100 may be a direct-transfer-type image forming apparatus configured to directly transfer a toner image formed on the electrophotographic photoreceptor 7 onto a recording medium.

EXAMPLES

The present invention will now be described through specific examples which do not limit the scope of the present invention. In the examples below, "parts" means parts by weight.

Preparation and Fabrication of Silica Particles Silica Particles (1)

To 100 parts by weight of untreated (hydrophilic) silica particles, OX50 (trade name, produced by AEROSIL CO., LTD.), 30 parts by weight of a hydrophobing agent, namely, 1,1,1,3,3,3-hexamethyldisilazane (produced by Tokyo Chemical Industry Co., Ltd.) is added, and the reaction is carried out for 24 hours. The reaction product is filtered to obtain hydrophobized silica particles. These silica particles are assumed to be silica particles (1). The condensation ratio of the silica particles (1) is 93%.

Example 1

Fabrication of Undercoat Layer

Zinc oxide (average particle size: 70 nm, produced by Tayca Corporation, specific surface area: 15 $m^2/g$) in an amount of 100 parts by weight is mixed and stirred with 500 parts by weight of tetrahydrofuran, and 1.3 parts by weight of a silane coupling agent (KBM503 produced by Shin-Etsu Chemical Co., Ltd.) is added to the resulting mixture, followed by stirring for 2 hours. Then tetrahydrofuran is distilled away at a reduced pressure, and baking is conducted at 120° C. for 3 hours. As a result, zinc oxide surface-treated with a silane coupling agent is obtained.

The surface-treated zinc oxide (zinc oxide surface-treated with a silane coupling agent) in an amount of 110 parts by weight is mixed and stirred with 500 parts by weight of tetrahydrofuran. A solution prepared by dissolving 0.6 part by weight of alizarin in 50 parts by weight of tetrahydrofuran is added to the resulting mixture, followed by stirring at 50° C. for 5 hours. The alizarin-added zinc oxide is filtered out by vacuum filtration and dried at 60° C. at a reduced pressure. As a result, alizarin-added zinc oxide is obtained.

Sixty parts by weight of the alizarin-added zinc oxide, 13.5 parts by weight of a curing agent (blocked isocyanate, Sumidur 3175 produced by Sumitomo Bayer Urethane Co., Ltd.), 15 parts by weight of butyral resin (S-LEC BM-1 produced by Sekisui Chemical Co., Ltd.), and 85 parts by weight of methyl ethyl ketone are mixed to prepare a mixture. Then this mixture in an amount of 38 parts by weight is mixed with 25 parts by weight of methyl ethyl ketone. The resulting mixture is dispersed for 2 hours in a sand mill using glass beads 1 mm in diameter to obtain a dispersion.

To the dispersion, 0.005 part by weight of dioctyltin dilaurate serving as a catalyst and 40 parts by weight of silicone resin particles (Tospearl 145 produced by Momentive Performance Materials Inc.) are added to obtain a coating solution for forming an undercoat layer. The coating solution is applied to an aluminum substrate having a diameter of 60 mm, a length of 357 mm, and a thickness of 1 mm by a dip coating technique and cured by drying at 170° C. for 40 minutes. As a result, an undercoat layer having a thickness of 19 μm is obtained.

Fabrication of Charge Generating Layer

A mixture containing 15 parts by weight of hydroxygallium phthalocyanine serving as a charge generating material and at least having diffraction peaks at Bragg angles (20) ±0.2° of 7.3°, 16.0°, 24.9°, and 28.0° in an X-ray diffraction spectrum taken with a Cu Kα X-ray, 10 parts by weight of a vinyl chloride-vinyl acetate copolymer (VMCH produced by NUC Corporation) serving as a binder resin, and 200 parts by weight of n-butyl acetate is dispersed for 4 hours in a sand mill with glass beads having a diameter of 1 mm. To the resulting dispersion, 175 parts by weight of n-butyl acetate and 180 parts by weight of methyl ethyl ketone are added, followed by stirring. As a result, a charge generating layer-forming coating solution is obtained. The charge generating layer-forming coating solution is applied to the undercoat layer by dip coating, and dried at room temperature (25° C.). As a result, a charge generating layer having a thickness of 0.2 μm is obtained.

Fabrication of Charge Transporting Layer

To 50 parts by weight of the silica particles (1), 250 parts by weight of tetrahydrofuran is added. While maintaining the temperature of the resulting mixture to 20° C., 25 parts by weight of 4-(2,2-diphenylethyl)-4',4"-dimethyl-triphenylamine and 25 parts by weight of bisphenol Z polycarbonate resin (viscosity-average molecular weight: 30,000) serving as a binder resin are added. The resulting mixture is mixed under stirring for 12 hours. As a result, a coating solution for forming a charge transporting layer is obtained.

The coating solution for forming a charge transporting layer is applied to the charge generating layer and dried at 135° C. for 40 minutes to form a charge transporting layer having a thickness of 30 μm. Thus, an electrophotographic photoreceptor is obtained.

Through the steps described above, an organic photoreceptor (1) in which an undercoat layer, a charge generating layer, and a charge transporting layer are stacked in that order on an aluminum substrate is obtained.

Formation of Inorganic Protective Layer

Next, an inorganic protective layer formed of hydrogen-containing gallium oxide is formed on the surface of the organic photoreceptor (1). Formation of the inorganic protective layer is done by using a film forming device having the structure illustrated in FIGS. 4A and 4B.

First, the organic photoreceptor (1) is placed on the substrate supporting unit 213 inside the deposition chamber 210 of the film forming device, and the interior of the deposition chamber 210 is vacuumed through the exhaust 211 until the pressure is 0.1 Pa.

Next, He-diluted 40% oxygen gas (flow rate: 5.3 sccm) and hydrogen gas (flow rate: 500 sccm) are introduced through the gas inlet duct 220 into the high-frequency discharge tube 221 equipped with the plate electrode 219 having a diameter of 85 mm. The high-frequency power supply unit 218 and a matching circuit (not illustrated in FIGS. 4A and 4B) are used to set the output of the 13.56 MHz radio wave to 500 W, and discharge is conducted from the plate electrode 219 while conducting matching with a tuner. The returning wave is 0 W.

Next, trimethyl gallium gas (flow rate: 7.5 sccm) is introduced from the shower nozzle 216 to the plasma diffusing unit 217 in the deposition chamber 210 through the gas inlet duct 215. The reaction pressure inside the deposition chamber 210 measured by a Baratron vacuum meter is 12.5 Pa.

Under such conditions, a step 1-1 of forming a film by rotating the organic photoreceptor (1) at a speed of 500 rpm is conducted.

Subsequently, while discharging and rotating of the organic photoreceptor (1) are continued, the following steps 1-2 to 1-7 are conducted as in step 1-1 except that the flow rate of the He-diluted 40% oxygen gas and the deposition time are changed as follows:

Step 1-2: The flow rate of the He-diluted 40% oxygen gas is 5.6 sccm and deposition is conducted for 10 minutes.

Step 1-3: The flow rate of the He-diluted 40% oxygen gas is 6.0 sccm and deposition is conducted for 12 minutes.

Step 1-4: The flow rate of the He-diluted 40% oxygen gas is 6.4 sccm and deposition is conducted for 13 minutes.

Step 1-5: The flow rate of the He-diluted 40% oxygen gas is 6.8 sccm and deposition is conducted for 15 minutes.

Step 1-6: The flow rate of the He-diluted 40% oxygen gas is 7.1 sccm and deposition is conducted for 20 minutes.

Step 1-7: The flow rate of the He-diluted 40% oxygen gas is 7.5 sccm and deposition is conducted for 15 minutes.

An inorganic protective layer having a total thickness of 1.0 μm is formed on the surface of the charge transporting layer of the organic photoreceptor (1) through the steps 1-1 to 1-7.

As a result of performing these steps, an electrophotographic photoreceptor of Example 1 including an undercoat layer, a charge generating layer, a charge transporting layer, and an inorganic protective layer sequentially formed on a conductive substrate is obtained.

A sample equivalent to the inner region of the inorganic protective layer, a sample equivalent to the outer region of the inorganic protective layer, and a sample equivalent to the inorganic protective layer as a whole are prepared by the methods described above. The volume resistivity and the optical absorption edge energy are measured in the inner region, the outer region, and the inorganic protective layer as a whole are measured by the methods described above. The results are indicated in Table.

Example 2

An electrophotographic photoreceptor is obtained as in Example 1 except that the following steps 2-1 to 2-4 are performed instead of steps 1-1 to 1-7 in forming the inorganic protective layer.

The following steps 2-1 to 2-4 are conducted as in step 1-1 of Example 1 except that the flow rate of the He-diluted 40% oxygen gas and the deposition time are changed as follows:

Step 2-1: The flow rate of the He-diluted 40% oxygen gas is 5.6 sccm and deposition is conducted for 23 minutes.

Step 2-2: The flow rate of the He-diluted 40% oxygen gas is 6.8 sccm and deposition is conducted for 22 minutes.

Step 2-3: The flow rate of the He-diluted 40% oxygen gas is 7.1 sccm and deposition is conducted for 22 minutes.

Step 2-4: The flow rate of the He-diluted 40% oxygen gas is 7.5 sccm and deposition is conducted for 22 minutes.

An inorganic protective layer having a total thickness of 1.0 μm is formed on the surface of the charge transporting layer of the organic photoreceptor (1) through the steps 2-1 to 2-4.

A sample equivalent to the inner region of the inorganic protective layer, a sample equivalent to the outer region of the inorganic protective layer, and a sample equivalent to the inorganic protective layer as a whole are prepared by the methods described above. The volume resistivity and the optical absorption edge energy are measured in the inner region, the outer region, and the inorganic protective layer as a whole are measured by the methods described above. The results are indicated in Table.

Comparative Example 1

An electrophotographic photoreceptor is obtained as in Example 1 except that the following step C1-1 is conducted instead of the steps 1-1 to 1-7 in forming the inorganic protective layer.

The step C1-1 is conducted as in step 1-1 of Example 1 except that the flow rate of the He-diluted 40% oxygen gas and the deposition time are changed as follows:

Step C1-1: The flow rate of the He-diluted 40% oxygen gas is 6.0 sccm and deposition is conducted for 90 minutes.

An inorganic protective layer having a thickness of 1.0 μm is formed on the surface of the charge transporting layer of the organic photoreceptor (1) through the step C1-1.

A sample equivalent to the inner region of the inorganic protective layer, a sample equivalent to the outer region of the inorganic protective layer, and a sample equivalent to the inorganic protective layer as a whole are prepared by the methods described above. The volume resistivity and the optical absorption edge energy are measured in the inner region, the outer region, and the inorganic protective layer as a whole are measured by the methods described above. The results are indicated in Table.

Comparative Example 2

An electrophotographic photoreceptor is obtained as in Example 1 except that the following step C2-1 is conducted instead of the steps 1-1 to 1-7 in forming the inorganic protective layer.

The step C2-1 is conducted as in step 1-1 of Example 1 except that the flow rate of the He-diluted 40% oxygen gas and the deposition time are changed as follows:

Step C2-1: The flow rate of the He-diluted 40% oxygen gas is 6.8 sccm and deposition is conducted for 84 minutes.

An inorganic protective layer having a thickness of 1.0 μm is formed on the surface of the charge transporting layer of the organic photoreceptor (1) through the step C2-1.

A sample equivalent to the inner region of the inorganic protective layer, a sample equivalent to the outer region of the inorganic protective layer, and a sample equivalent to the inorganic protective layer as a whole are prepared by the methods described above. The volume resistivity and the optical absorption edge energy are measured in the inner region, the outer region, and the inorganic protective layer as a whole are measured by the methods described above. The results are indicated in Table.

Comparative Example 3

An electrophotographic photoreceptor is obtained as in Example 1 except that the following steps C3-1 to C3-4 are conducted instead of the steps 1-1 to 1-7 in forming the inorganic protective layer.

The steps C3-1 to C3-4 are conducted as in step 1-1 of Example 1 except that the flow rate of the He-diluted 40% oxygen gas and the deposition time are changed as follows:

Step C3-1: The flow rate of the He-diluted 40% oxygen gas is 6.4 sccm and deposition is conducted for 21 minutes.

Step C3-2: The flow rate of the He-diluted 40% oxygen gas is 7.5 sccm and deposition is conducted for 21 minutes.

Step C3-3: The flow rate of the He-diluted 40% oxygen gas is 7.9 sccm and deposition is conducted for 21 minutes.

Step C3-4: The flow rate of the He-diluted 40% oxygen gas is 8.3 sccm and deposition is conducted for 21 minutes.

An inorganic protective layer having a total thickness of 1.0 μm is formed on the surface of the charge transporting layer of the organic photoreceptor (1) through the steps C3-1 to C3-4.

A sample equivalent to the inner region of the inorganic protective layer, a sample equivalent to the outer region of the inorganic protective layer, and a sample equivalent to the inorganic protective layer as a whole are prepared by the methods described above. The volume resistivity and the optical absorption edge energy are measured in the inner region, the outer region, and the inorganic protective layer as a whole are measured by the methods described above. The results are indicated in Table.

Evaluation

The electrophotographic photoreceptors obtained in Examples and Comparative Examples are evaluated in terms of image defects caused by scratches, image deletion, and sensitivity, as described below. Evaluation is conducted by attaching the electrophotographic photoreceptor of each example to an image forming apparatus, DocuCentre-V C7775, produced by Fuji Xerox Co., Ltd.

Evaluation of Image Defects Caused by Scratches

Each of the electrophotographic photoreceptors obtained in Examples and Comparative Examples is attached to an image forming apparatus (DocuCentre-V C7775 produced by Fuji Xerox Co., Ltd.). Output is continuously made on 10,000 sheets at a temperature of 20° C. and a humidity of 40% RH, then continuously made on another 10,000 sheets at a temperature of 28° C. and a humidity of 85% RH, and then continuously made on another 10,000 sheets at a temperature of 10° C. and a humidity of 15% RH. Subsequently, a halftone (30%, 200 dpi (dot per inch)) image sample is output on 10 sheets at a temperature of 20° C. and a humidity of 40% RH. Whether a density nonuniformity occurs in the tenth sheet of the image sample is evaluated with the naked eye.

Evaluation standards are as follows. The results are indicated in Table ("Image defects" in Table).

A: No difference in image density is found between the portion where cracking of the inorganic protective layer occurs and its surrounding portion. No density nonuniformity is found.

B: There is a slight difference in image density between the portion where cracking of the inorganic protective layer occurs and its surrounding portion. If observed carefully with the naked eye, the density nonuniformity is recognizable.

C: There is a difference in image density between the portion where cracking of the inorganic protective layer occurs and its surrounding portion. The density nonuniformity is clearly identified with naked eye.

Evaluation of Image Deletion

Each of the electrophotographic photoreceptors obtained in Examples and Comparative Examples is attached to an image forming apparatus (DocuCentre-V C7775 produced by Fuji Xerox Co., Ltd.). A chart image having an image density (area coverage) of 5% is continuously output on 5,000 A4 sheets in an environment having a temperature of 28° C. and a humidity of 85% RH. The apparatus is then left standing in the same environment for 14 hours. After 14 hours, a halftone image having an image density of 40% and covering all parts of a sheet is output on 100 sheets. Whether image deletion is found in the image output after the apparatus is left standing is checked on the first sheet to the tenth sheet, the 50th sheet, and the 100th sheet.

The evaluation standards are as follows. The results are indicated in Table ("Image deletion" in Table).

A: The dots in the image on the first sheet output after the apparatus is left standing are in order.

B: The dots in the image on the first sheet output after the apparatus is left standing are disordered, but the order of the dots is recovered by the second to tenth sheets output after the apparatus is left standing (since the order is recovered quickly, image quality is acceptable).

C: The dots in the image on the first to tenth sheets output after the apparatus is left standing are disordered, but the order of the dots is recovered by the 50th sheets output after the apparatus is left standing.

D: The dots in the image on the 50th sheet output after the apparatus is left standing are disordered. The dots are slightly disordered on the 100th sheet output after the apparatus is left standing, or the dots are slightly disordered even when 5000 sheets of output are continuously made before the apparatus is left standing.

Evaluation of Sensitivity

First, the surface of each of the electrophotographic photoreceptor obtained in the Examples and Comparative Examples is negatively charged to −700 V by using a scorotron charger. Next, the negatively charged electrophotographic photoreceptor is exposed to light for exposure (light source: semiconductor laser, wavelength: 780 nm, output: 5 mW) to erase charges. The potential attenuation ($V \cdot m^2/mJ$) per unit light intensity is determined and assumed to be a sensitivity A ($V \cdot m^2/mJ$) of the electrophotographic photoreceptor.

The sensitivity is measured as described above except that the organic photoreceptor (1) before formation of the inorganic protective layer is used instead of the electrophotographic photoreceptor. The potential attenuation ($V \cdot m^2/mJ$) per unit light intensity is determined and assumed to be a sensitivity B ($V \cdot m^2/mJ$) of the organic photoreceptor (1).

The rate of decrease in sensitivity by formation of the inorganic protective layer is determined by the equation below and the results are indicated in Table ("Sensitivity" in Table).

$$\text{Rate of decrease in sensitivity (\%)} = ((\text{sensitivity } B - \text{sensitivity } A)/\text{sensitivity } B) \times 100 \quad \text{Equation:}$$

The lower the value of the rate of decrease in sensitivity, the higher the sensitivity of the photoreceptor.

TABLE

| | Volume resistivity (Ω · cm) | | | Optical absorption edge energy (eV) | | | Evaluation | | |
|---|---|---|---|---|---|---|---|---|---|
| | Inner region | Outer region | Whole | Inner region | Outer region | Whole | Image defects | Image deletion | Sensitivity (%) |
| Example 1 | $4.0 \times 10^8$ | $1.0 \times 10^8$ | $1.5 \times 10^8$ | 2.20 | 2.12 | 2.19 | A | A | 20 |
| Example 2 | $6.0 \times 10^7$ | $3.0 \times 10^8$ | $2.6 \times 10^8$ | 2.10 | 2.53 | 2.26 | B | B | 20 |
| Comparative Example 1 | $3.0 \times 10^9$ | $1.5 \times 10^7$ | $1.3 \times 10^8$ | 2.14 | 1.95 | 1.95 | C | D | 20 |
| Comparative Example 2 | $1.0 \times 10^{10}$ | $1.0 \times 10^8$ | $3.5 \times 10^8$ | 2.64 | 2.12 | 2.15 | C | A | 20 |
| Comparative Example 3 | $2.0 \times 10^9$ | $1.0 \times 10^9$ | $1.5 \times 10^8$ | 2.62 | 2.53 | 2.60 | C | A | 10 |

The results above illustrate that in Examples, keeping scratches on the outer peripheral surface of the inorganic protective layer from appearing in the image and suppressing image deletion are achieved at a high level compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

an organic photosensitive layer on an outer peripheral surface of the conductive substrate; and an inorganic protective layer on an outer peripheral surface of the organic photosensitive layer, the inorganic protective layer containing gallium and oxygen, wherein a volume resistivity of an inner region of the inorganic protective layer, the inner region extending about 0.2 μm from an inner peripheral surface of the inorganic protective layer in a thickness direction, and a volume resistivity of an outer region of the inorganic protective layer, the outer region extending about 0.2 μm from an outer peripheral surface of the inorganic protective layer in the thickness direction, are both about $6.0\times10^7$ Ω·cm or more and about $4.0\times10^8$ Ω·cm or less, wherein the inorganic protective layer has a thickness of about 0.4 μm or more.

2. The electrophotographic photoreceptor according to claim 1, wherein at least one of the inner region and the outer region of the inorganic protective layer has a volume resistivity of about $1.0\times10^8$ Ω·cm or more and about $4.0\times10^8$ Ω·cm or less.

3. The electrophotographic photoreceptor according to claim 1, wherein the inorganic protective layer as a whole has a volume resistivity of about $1.0\times10^8$ Ω·cm or more and about $4.0\times10^8$ Ω·cm or less.

4. An image forming apparatus comprising:

the electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image on the surface of the electrophotographic photoreceptor by using a developer that contains a toner so as to form a toner image; and a transfer unit that transfers the toner image onto a surface of a recording medium.

* * * * *